US006505551B1

(12) United States Patent
Kawabe et al.

(10) Patent No.: US 6,505,551 B1
(45) Date of Patent: Jan. 14, 2003

(54) STENCIL PRINTING MACHINE HAVING MEANS TO HOLD BOTH ENDS OF STENCIL SHEET

(75) Inventors: Takao Kawabe, Ibaraki-ken (JP); Yasuhiro Takahashi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 41 days.

(21) Appl. No.: 09/671,830

(22) Filed: Sep. 27, 2000

(30) Foreign Application Priority Data

Oct. 5, 1999 (JP) ..... 11-284428
Dec. 22, 1999 (JP) ..... 11-365046

(51) Int. Cl.[7] ..... B41L 13/06; B41F 27/12
(52) U.S. Cl. ..... 101/116; 101/415.1
(58) Field of Search ..... 101/116, 127.1, 101/128.1, 129, 415.1, 477

(56) References Cited

U.S. PATENT DOCUMENTS 809,288 A * 1/1906 Dick ..... 101/415.1
1,733,438 A * 10/1929 Wagner ..... 101/128.1
2,697,397 A * 12/1954 Bailey ..... 101/116
3,664,260 A 5/1972 Miller et al. ..... 101/415.1
4,103,615 A * 8/1978 Cruz et al. ..... 101/115
5,456,177 A * 10/1995 Hasegawa ..... 101/382.1
5,943,954 A 8/1999 Otomo ..... 101/120
6,026,745 A * 2/2000 Hirokawa et al. ..... 101/415.1

FOREIGN PATENT DOCUMENTS

EP 0 110 204 6/1984

* cited by examiner

*Primary Examiner*—Leslie J. Evanisko

(57) ABSTRACT

A stencil printing machine includes a printing drum for receiving a perforated stencil sheet around an outer peripheral surface thereof. The printing drum is rotatable about a central axis thereof. The printing machine further includes a first holding device provided to the outer peripheral surface of the printing drum for holding a leading end of the stencil sheet, and a second holding device provided to the outer peripheral surface of the printing drum for holding a trailing end of the stencil sheet.

9 Claims, 18 Drawing Sheets

STENCIL PRINTING MACHINE HAVING MEANS TO HOLD BOTH ENDS OF STENCIL SHEET

BACKGROUND OF THE INVENTION

1. Field of the Invention

The present invention relates to a stencil printing machine having a cylindrical printing drum which has a stencil sheet wound around an outer peripheral surface thereof and is rotatably driven.

2. Description of the Related Art

FIG. 16 is a cross-sectional view showing a basic structure of a conventional stencil printing machine.

The stencil printing machine includes a printing drum 100. The printing drum 100 has a base body 103 which is comprised of a pair of circular plate members 101 arranged coaxially on a common central axis and a stencil clamping base 102 which connects a pair of circular plate members 101. A gear 104 is fixedly and coaxially mounted on the base body 103. The gear 104 is meshed with a drive gear not shown in the drawing. Upon rotation of the drive gear, the base body 103 is rotatably driven about the central axis.

An ink passing and flexible ink passing member 105 is wound around the base body 103. The ink passing member 105 has one end thereof fixedly secured to the stencil clamping base 102 of the base body 103. The ink passing member 105 is wound around outer peripheral surfaces of the circular plate members 101. The ink passing member 105 has the other end thereof elastically mounted on the stencil clamping base 102 by means of a spring 106. Accordingly, when the ink passing member 105 is pushed from the inside, the ink passing member 105 is elastically deformed outwardly. The stencil clamping base 102 is provided with clamp means 107. A perforated stencil sheet has a leading end thereof fixedly secured to the stencil clamping base 102 by means of clamp means 107 and is wound around an outer peripheral surface of the ink passing member 105.

In the inside of the printing drum 100, a squeezing roller 110 is elevatably mounted. In synchronous with the rotation of the printing drum 100, the squeezing roller 110 is elevated at a given timing and presses the ink passing member 105 outwardly. The squeezing roller 110 is rotatably driven in the same direction as the printing drum 100 in an interlocking manner with the printing drum 100 by means of the drive gear 104 of the printing drum 100, an intermediate gear 111 and a gear 112 of the squeezing roller 110. Ink is supplied to the inside of the printing drum 100 by way of an ink supply pipe 113 and a constant amount of ink is supplied to a peripheral surface of the squeezing roller 110 by means of a doctor roller 114 which is arranged against the squeezing roller 110 at a given interval.

Although not shown in the drawing, a pressure drum having a diameter approximately equal to that of the printing drum 100 is disposed below the printing drum 100. The axis of rotation of the pressure drum is parallel to the central axis of the printing drum 100. In the non-printing state, a minute clearance is formed between the printing drum 100 and the pressure drum. The pressure drum is rotatably driven in synchronous with the rotation of the printing drum 100 but in the opposite direction. A printing paper is fed between the printing drum 100 and the pressure drum. The squeezing roller 110 is lowered at a given timing so as to push the ink passing member 105 outwardly. The ink passing member 105 which is deformed outwardly and a stencil sheet clamp the printing paper between these members and the pressure drum. The printing paper is conveyed while being clamped between the deformed printing drum 100 and the pressure drum. During the conveyance, ink supplied to the inner peripheral surface of the ink passing member 105 is transferred to the printing paper through the ink passing member 105 and a perforated portion of the stencil sheet thus forming an image.

An image of an original to be printed is read by an image reader 200 and is supplied to a stencil making section 300 as image signals.

The stencil making section 300 includes a platen roller 301 and a thermal head 302. The stencil sheet M having a roll shape is clamped between the platen roller 301 and the thermal head 302 and is conveyed. During conveyance, the thermal head 302 is driven by an image signal fed from the image reader 200 and generates heat and forms a perforated image in the stencil sheet M. The stencil sheet M in which the perforated image is formed is conveyed to a position in the vicinity of the printing drum 100 by means of the platen roller 301 and feed rollers 303. The stencil sheet M has a leading end portion thereof fixedly secured onto the stencil clamping base 102 by means of the clamp means 107 and is wound around the outer peripheral surface of the printing drum 100 along with the rotation of the printing drum 100 in the counterclockwise direction in the drawing. When the stencil sheet M is wound around the printing drum 100 by a given dimension corresponding to one sheet, the stencil sheet M is cut by a cutter 304. This cut portion disposed at the side opposite to the leading end portion of the stencil sheet M which is fixedly secured to the clamp means 107 constitutes a trailing end portion of the stencil sheet M.

Thereafter, the printing is performed. After printing, the used stencil sheet M is peeled off from the printing drum 100 and is removed. With the clamp means 107 in the opened state, the printing drum 100 is rotated. The leading end portion of the stencil sheet M released from the clamp means 107 is clamped between a pair of stencil discharge rollers 401 and is stacked in a stencil discharge section 400 including a stencil discharge box by driving the stencil discharge rollers 401. At the time of discharging the used stencil sheet M, ink remaining on the used stencil sheet M is adhered to the stencil discharge rollers 401.

In the above-mentioned state, when the stencil making and the printing are performed based on a new image, at the time of winding the newly perforated stencil sheet M which is fed from the feed rollers 303 around the printing drum 100 and printing, there has been a trouble that the trailing end portion which is not fixedly secured by the clamp means 107 is lifted and comes into contact with the stencil discharge roller 401 or the like so that ink is adhered to it. Further, it gives rise to several problems including a problem that ink adhered to the trailing end portion of the stencil sheet M is transferred to the printing member thus staining the printing paper.

Further, in the stencil printing machine, in case of performing a duplex printing, as shown in FIG. 17, for example, it is considered to prepare two rotatable cylindrical printing drums 501, 502 which have outer peripheral surfaces thereof wound around by stencil sheets M. These printing drums 501, 502 have axes of rotation which are disposed parallel to each other. Further, in the insides of respective printing drums 501, 502, squeezing rollers 503, 504 which supply ink to the outer peripheries of the printing drums 501, 502 are disposed. Subsequently, a printing paper P is fed between respective printing drums 501, 502 and then the printing paper P is nipped between the outer peripheral surfaces of the printing drums 501, 502 so as to transfer the ink which passes through the stencil sheets M onto the printing paper P thus completing the duplex printing.

Further, for winding the stencil sheets M around the outer peripheral surfaces of the printing drums, the printing drums 501, 502 are respectively provided with stopper mechanisms for clamping leading end portions of the conveyed stencil sheets M to portions of the outer peripheral surfaces of the printing drums 501, 502. These stopper mechanisms include clamp plates 505, 506 which can be opened and closed. The clamp plates 505, 506 clamp the leading end portions of the stencil sheets M by closing operations and release the leading end portions of the stencil sheets M by opening operations.

Further, the above-mentioned stopper mechanisms respectively clamp the leading end portions of the stencil sheets M such that the leading end portions of the stencil sheets M are directed toward the rotational directions of the printing drums 501, 502. Then, in the conventional stencil printing machine, respective printing drums 501, 502 have the same diameter and are rotated at the same peripheral speed. That is, in the conventional stencil printing machine, when the printing drums 501, 502 are rotated, the stencil sheets M are brought into contact with the printing paper P and receive loads and hence, the leading end portions of the stencil sheets M are uniformly pulled.

However, in the above-mentioned conventional stencil printing machine, although respective printing drums 501, 502 are designed such that they have the same diameter to be rotated at the same peripheral speed theoretically, to observe the entire periphery of the printing drum 501 (502) locally, there exists a case that their diameters are slightly different from each other. In this manner, when there exists the difference in diameter between respective printing drums 501, 502, the line speeds of respective stencil sheets M wound around respective printing drums 501, 502 become different from each other and hence, stresses which make respective stencil sheets M move in the winding direction work on respective stencil sheets M.

To be more specific, when the diameter of the upper-side printing drum 501 is made large, the line speed of the stencil sheet M wound around the printing drum 501 is increased, while the line speed of the stencil sheet M wound around the lower-side printing drum 502 having the small diameter is decreased.

Then, as shown in FIG. 18, the printing paper P is brought into contact with respective stencil sheets M which differ in line speed. In this case, although the stencil sheet M of the upper-side printing drum 501 receives a stress F1 which resists the rotational direction of the printing drum 501, since the leading end portion is clamped by the stopper mechanism, the stencil sheet M is not moved. To the contrary, since the stencil sheet M of the lower-side printing drum 502 receives a stress F2 which follows the rotational direction of the printing drum 502, the stencil sheet M is moved in the direction of the leading end portion which is clamped by the stopper mechanism so that the stencil sheet M is displaced from its original position. Accordingly, there have been several problems including following problems. That is, a printed image formed by the stencil sheet M wound around the lower-side printing drum 502 having the low line speed is shrunk or contracted or wrinkles are formed on the stencil sheet M. Since the stencil sheet M moves to a position where the stencil sheet M cannot cover a printing region (a region which allows ink to pass through) of the printing drum 502, the printing paper P is stained.

Accordingly, it is an object of the present invention to provide a stencil printing machine which can prevent ink from staining a trailing end portion of a stencil sheet and accordingly preventing such ink from adhering to and staining a printing paper.

It is another object of the present invention to provide a stencil printing machine which can prevent the movement of stencil sheets wound around respective printing drums when a printing is performed on both surfaces of a printing sheet between a plurality of printing drums simultaneously.

SUMMARY OF THE INVENTION

According to the first aspect of the present invention, there is provided a stencil printing machine comprising a printing drum 1 which has a perforated stencil sheet M wound around an outer peripheral surface thereof and is rotatable about a central axis thereof, first holding means 10 which is provided to the outer peripheral surface of the printing drum and holds a leading end of the stencil sheet, and second holding means 18 which is provided to the outer peripheral surface of the printing drum and holds a trailing end of the stencil sheet.

According to the second aspect of the present invention, in the stencil printing machine of the first aspect of the present invention, a fan 32 is provided at a position in the vicinity of the printing drum 1 and the fan 32 blows wind to the trailing end of the stencil sheet M wound around the outer peripheral surface of the printing drum so as to move the trailing end toward the outer peripheral surface of the printing drum thereby enabling the second holding means 18 to hold the trailing end between the second holding means 18 and the printing drum.

According to the third aspect of the present invention, in the stencil printing machine of the first aspect of the present invention, a press member (a press roller 60) is movably provided at a position in the vicinity of the printing drum 1 and the press member presses the trailing end of the stencil sheet M wound around the outer peripheral surface of the printing drum onto the outer peripheral surface of the printing drum thereby enabling the second holding means 18 to hold the trailing end between the second holding means 18 and the printing drum.

According to the fourth aspect of the present invention, there is provided a stencil printing machine including a base body 3 which is comprised of a pair of circular plate members 4 which are arranged coaxially on a common central axis and a first base member (a first stencil clamping base 5) which connects a pair of the circular plate members. The base body 3 is rotatable about the above-mentioned central axis. Further, the stencil printing machine includes an ink passing member 15 which has one end portion thereof mounted on the base body, is wound around a pair of circular plate members and forms a peripheral surface for mounting a stencil sheet M thereon. Further, the stencil printing machine includes a second base member (a second stencil clamping base 16) which is mounted on the other end of the ink passing member, an elastic member (a spring 17) which connects the second base member to the base body such that the ink passing member is wound around a pair of circular plate members with a given force and first holding means 10 which is mounted on the base body for holding a leading end of a stencil sheet M, and second holding means 18 which is mounted on the second base body for holding a trailing end of the stencil sheet M.

According to the fifth aspect of the present invention, there is provided a stencil printing machine including at least two printing drums 1, 2 which wind perforated stencil sheets on outer peripheral surfaces thereof and are rotatable about central axes thereof, first holding means 10, 10 which are provided to outer peripheral surfaces of the respective printing drums 1, 2 for holding leading end portions of the stencil sheets M, M, and second holding means 18, 18 which are provided to outer peripheral surfaces of the respective printing drums 1, 2 for holding trailing end portions of the stencil sheets M, M.

According to the sixth aspect of the present invention, in the stencil printing machine of the fifth aspect of the present invention, the peripheral speed of one of the printing drums 1(2) is set slower than the peripheral speed of the other printing drum 2(1).

According to the seventh aspect of the present invention, in the stencil printing machine of the sixth aspect of the present invention, the peripheral speeds of respective printing drums 1, 2 are set by changing the diameters of outer peripheral surfaces of the respective printing drums 1, 2.

According to the eighth aspect of the present invention, in the stencil printing machine of any one of fifth to seventh aspects of the present invention, fans 32, 32 are provided at positions in the vicinity of the respective printing drums 1, 2 and the fan 32, 32 blow wind to the respective trailing end portions of the stencil sheets M, M wound around the outer peripheral surfaces of the printing drums 1, 2 so as to move the trailing end portions toward the outer peripheral surfaces of the printing drums thereby enabling the second holding means 18, 18 to hold the trailing end portions between the second holding means 18, 18 and the printing drums 1, 2.

According to the ninth aspect of the present invention, in the stencil printing machine of any one of fifth to seventh aspects of the present invention, press members (press rollers 60, 60) are movably provided at positions in the vicinity of the printing drums 1,2 and the press members press the respective trailing end portions of the stencil sheets M, M wound around the outer peripheral surfaces of the printing drums 1, 2 onto the outer peripheral surfaces of the printing drums 1, 2 thereby enabling the second holding means 18, 18 to hold the trailing end portions between the second holding means 18, 18 and the printing drums 1, 2.

DETAILED DESCRIPTION OF THE PREFERRED EMBODIMENTS

[Embodiment A]

Figure 16:
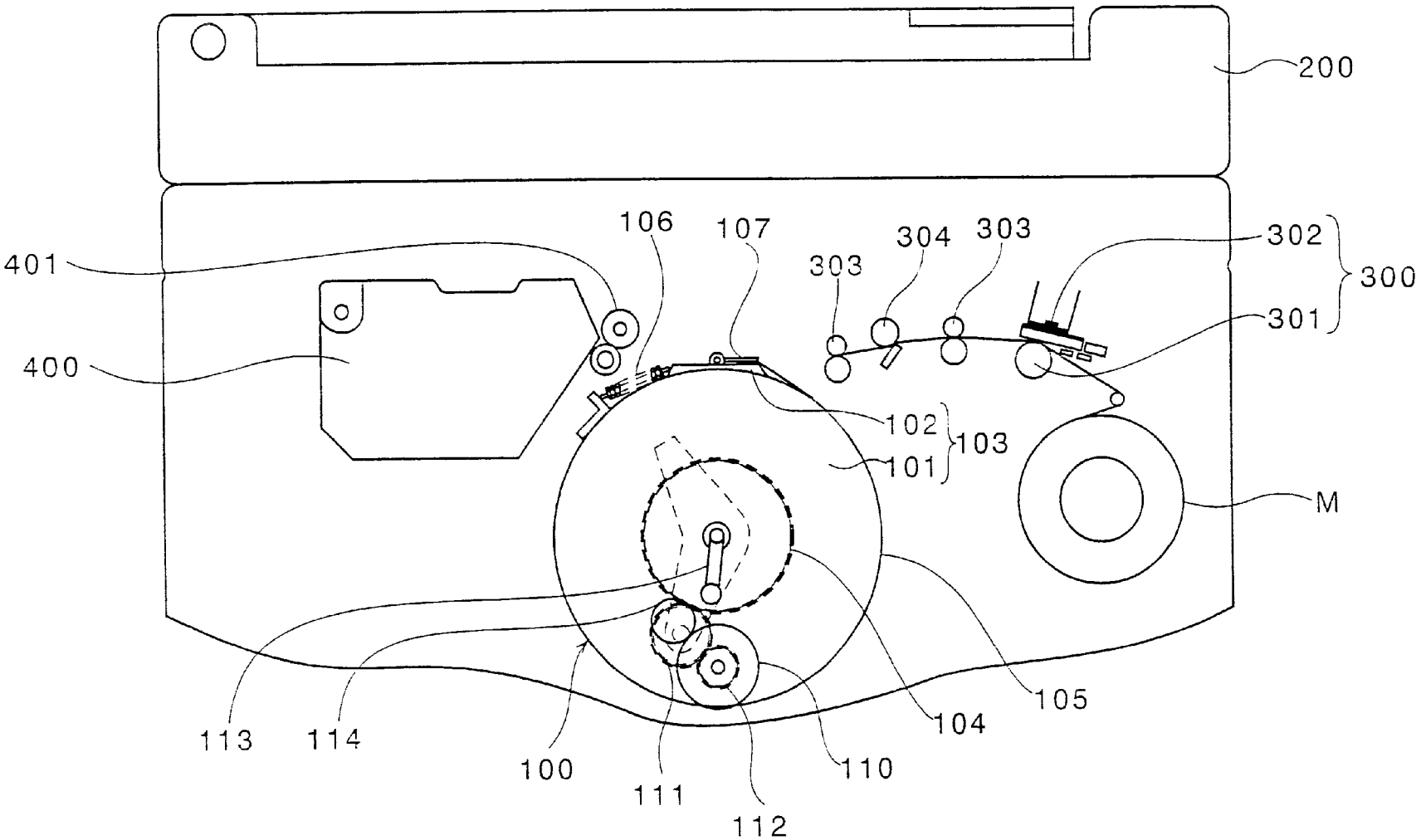
FIG. 16 Prior Art
FIG. 16 is a cross-sectional view showing the basic structure of a conventional stencil printing machine.
Figure 17:
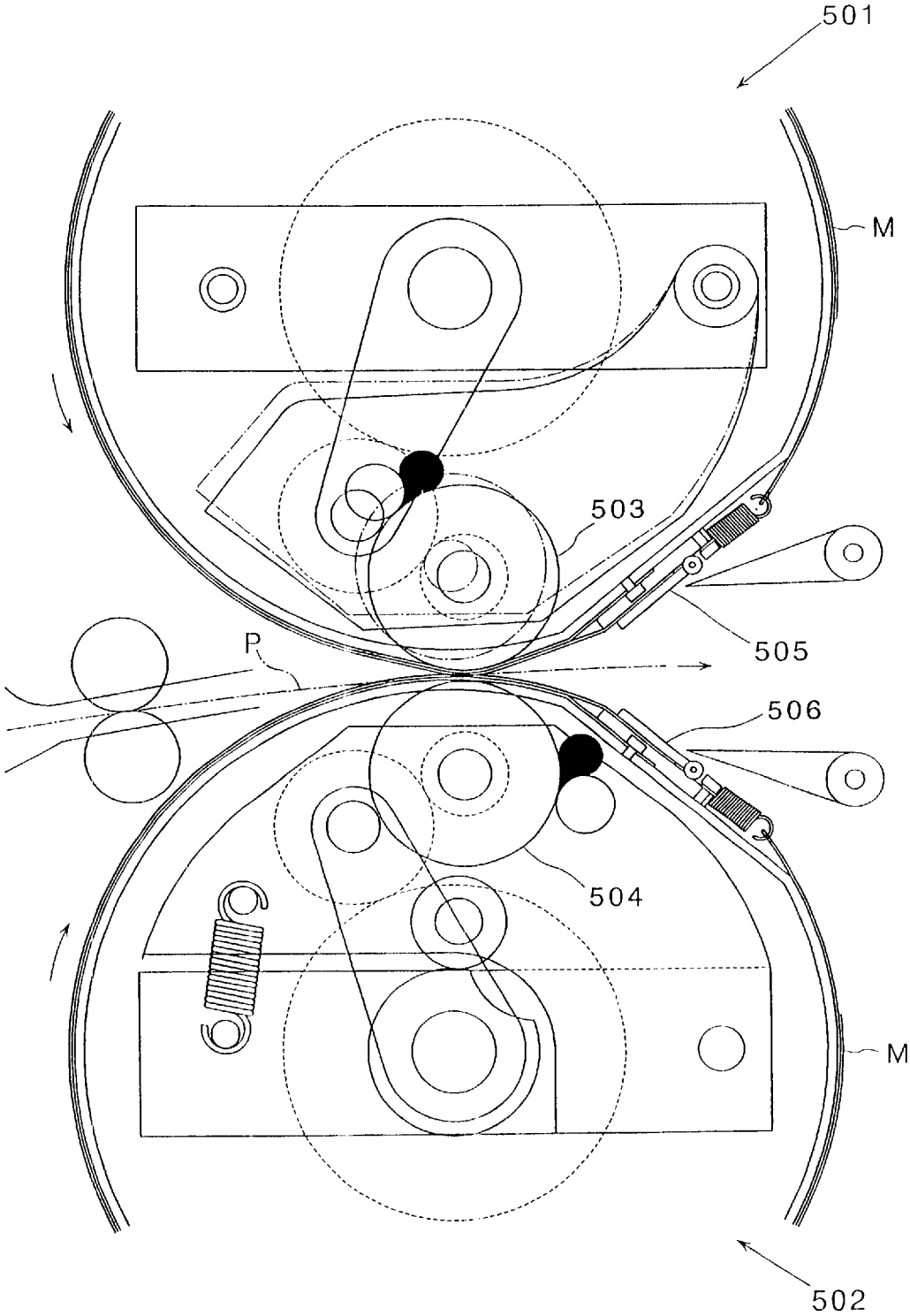
FIG. 17 Prior Art
FIG. 17 is a side view showing the conventional stencil printing machine.
Figure 18:
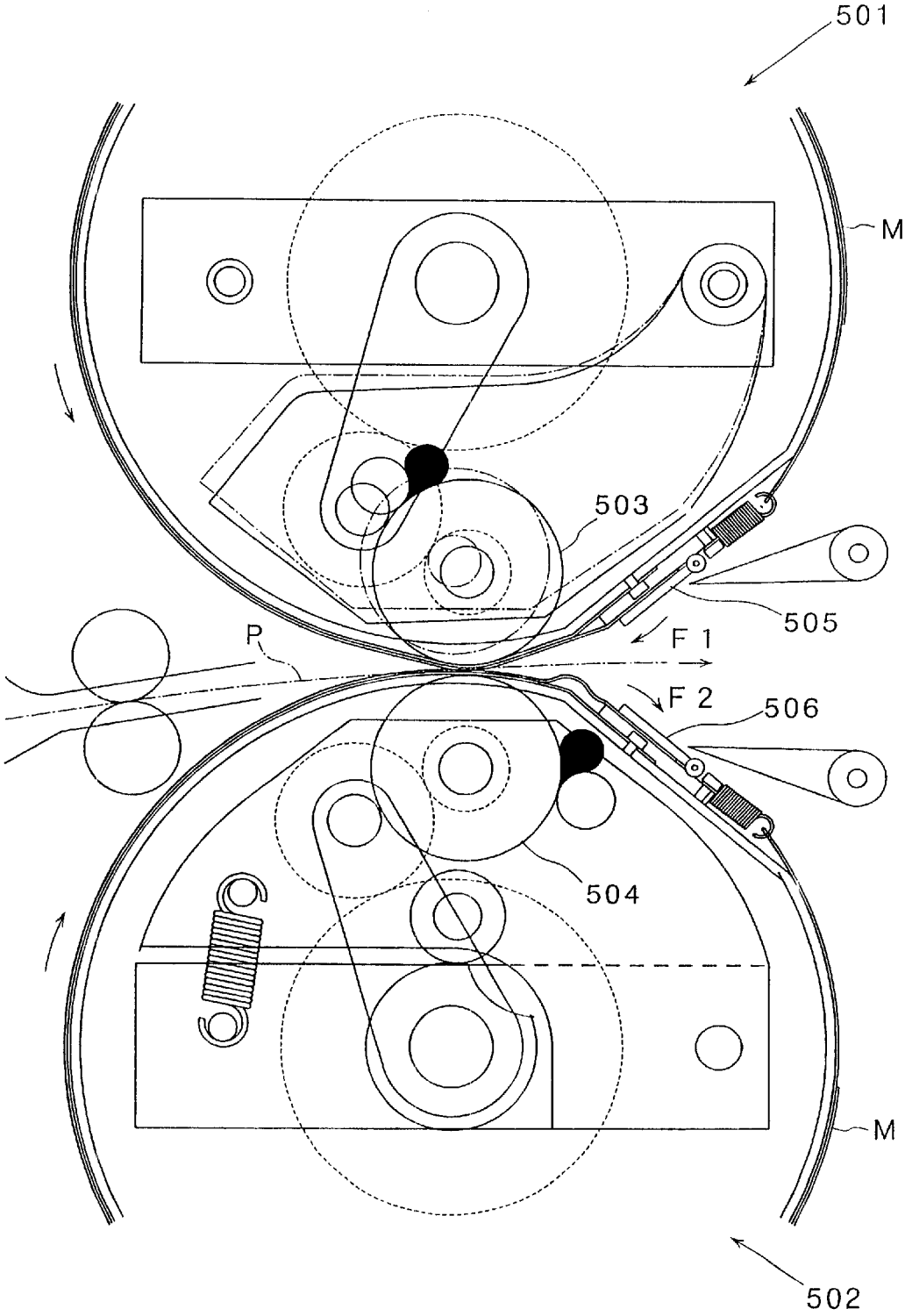
FIG. 18 Prior Art
FIG. 18 is a side view showing the operation of the conventional stencil printing machine at the time of printing.

One embodiment of a stencil printing machine of the present invention is explained in detail in conjunction with FIG. 1 to FIG. 5. In this embodiment, the explanation is substantially focused to the printing means comprised of a printing drum and a pressure drum. With respect to paper feed means, paper discharge means, stencil making means, stencil discharge means, original reading means and the like, the stencil printing machine of the present invention has the same constitutions as those of the conventional machine shown in FIG. 16 and hence, the explanation thereof is omitted.

Figure 1:
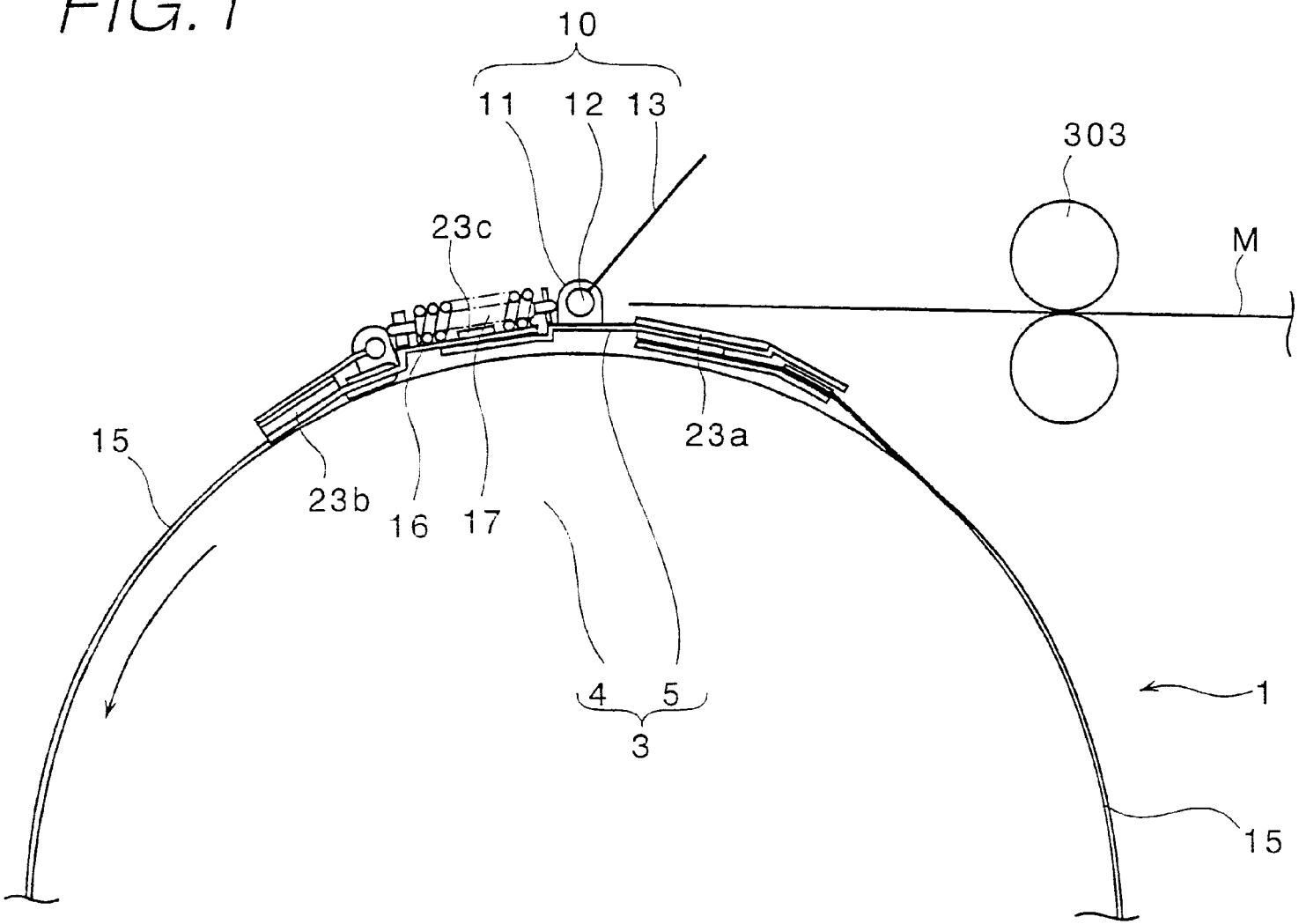
FIG. 1 is a cross-sectional view showing the first embodiment of the present invention.
Figure 2:
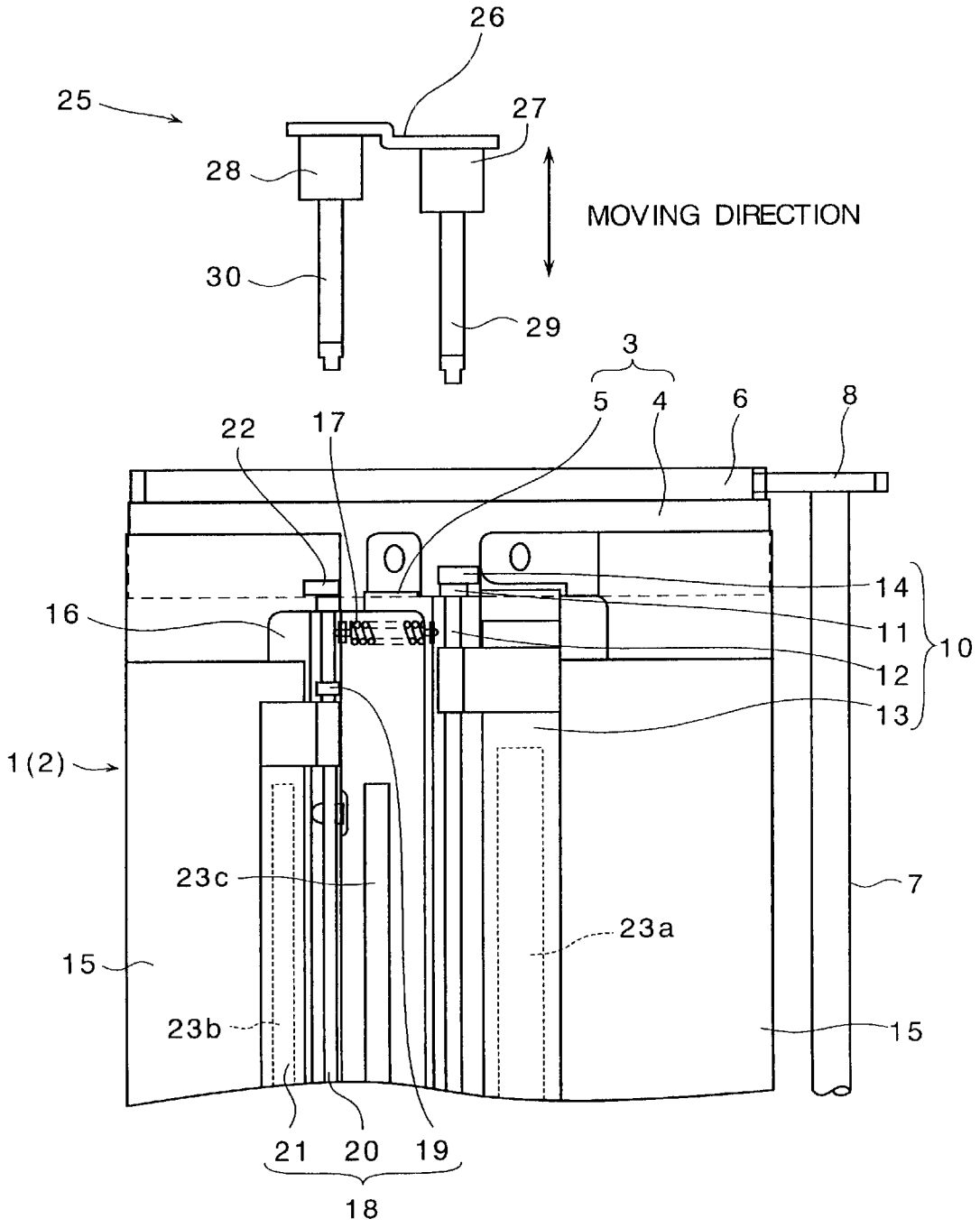
FIG. 2 is a plan view showing one half portion of the first embodiment.
Figure 3:
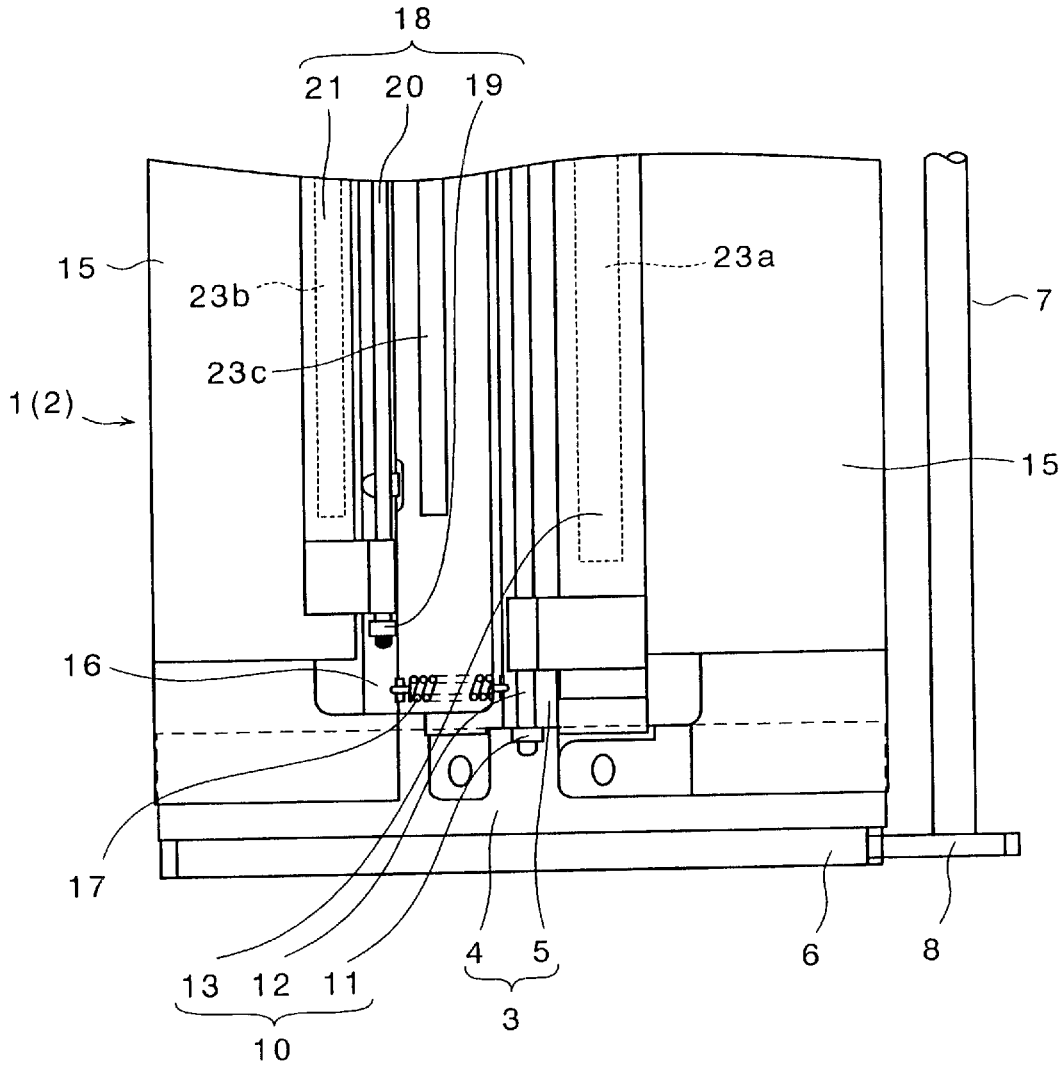
FIG. 3 is a plan view showing the other half portion of the first embodiment.

The structure of the printing drum 1 is explained in conjunction with FIG. 1 to FIG. 3.

The printing drum 1 includes a base body 3. The base body 3 is provided with a pair of circular plate members 4 which are disposed coaxially on a common central axis and a first stencil clamping base 5 which connects a pair of circular plate members 4. The longitudinal direction of the first stencil clamping base 5 is in parallel to the central axis of the circular plate members 4.

As shown in FIG. 2 and FIG. 3, driven gears 6 are respectively coaxially and fixedly secured to outside end faces of the circular plate members 4. In the vicinity of the base body 3, a drive shaft 7 which is operably connected to a drive source not shown in the drawing is disposed. The drive shaft 7 is disposed parallel to a central axis of the circular plate members 4 and drive gears 8 are respectively fixedly secured to both ends of the drive shaft 7. The drive gear 8 is meshed with the driven gear 6. Upon driving of the drive source not shown in the drawing, the drive shaft 7 is rotated and the drive gears 8 rotate the driven gears 6 so that the base body 3 is rotatably driven about a central axis thereof.

First holding means 10 is mounted on the first stencil clamping base 5. The first holding means 10 includes a plurality of pivotal bearings 11 fixedly secured to the first stencil clamping base 5, a rotary shaft 12 rotatably supported by the pivotal bearings 11 and a first clamp plate 13 made of metal which is mounted on the rotary shaft 12. The rotary shaft 12 is parallel to the central axis of the base body 3. As shown in FIG. 2, a first connecting plate 14 is mounted on one end portion of the rotary shaft 12. The first connecting plate 14 is detachably connected to a drive mechanism described later.

One end portion of an ink passing member 15 is mounted on one end portion of the first stencil clamping base 5. One end portion of this ink passing member 15 is positioned at the upstream side with respect to the direction of the rotation of the printing drum 1. At least a portion of the ink passing member 15 is made of an ink passing and flexible material. The ink passing member 15 is wound around the base body 3 toward the downstream with respect to the rotating direction such that a pair of side brim portions are brought into slide contact with peripheral surfaces of a pair of circular plate members 4. To the other end portion of the ink passing member 15, a second stencil clamping base 16 which is elongated in the axial direction is fixedly secured. The other end portion of the ink passing member 15 is disposed at the downstream side with respect to the rotating direction of the printing drum 1. The second stencil clamping base 16 is mounted on the other end portion of the first stencil clamping base 5 by way of a spring 17 which constitutes an elastic member. As shown in FIG. 1, a portion of the second stencil clamping base 16 is overlapped with a portion of the first stencil clamping base 5 such that they are overlapped in a slidable manner. In such a constitution, the ink passing member 15 is pulled toward the downstream side with respect to the rotating direction due to the elastic force of the spring 17 and is wound around the peripheral surfaces of a pair of circular plate members 4. Accordingly, the ink passing member 15 has a cylindrical shape as a whole. When the ink passing member 15 is pushed from the inside, the ink passing member 15 slides on the peripheral surfaces of the circular plate members 4 and is bulged outwardly, while when the power is released, the ink passing member 15 returns to the initial position due to the spring 17.

Second holding means 18 includes a second stencil clamping base 16, bearings 19, a rotary shaft 20 rotatably supported by the bearings 19, and a second clamping plate 21. The second clamping plate 21 has a second connecting plate 22 at one end thereof.

When the first clamp plate 13 is held at a position turned down toward one end portion side of the ink passing member 15 as shown in FIG. 3, the first clamp plate 13 is attracted by and fixedly secured to a magnet plate 23*a* disposed at the first stencil clamping base 5. A first clamp plate 13 clamps the leading end portion of the stencil sheet M which is perforated at a stencil making section not shown in the drawing and conveyed between the first clamp 13 and the magnet plate 23*a*. The stencil sheet M whose leading end portion is clamped by the first clamp plate 13 is wound around the ink passing member 15 along with the rotation of the first printing drum 1.

At a position where a second clamp plate 21 is turned down toward the other end portion side of the ink passing member 15 as shown in FIG. 3, the second clamp plate 21 is attracted by and fixedly secured to a magnet plate 23*b* disposed at the second stencil clamping base 16. The second clamp plate 21 clamps the trailing end portion of the stencil sheet M wound around the ink passing member 15 between the second clamp plate 21 and a magnet plate 23*b*.

Further, in one region of the second stencil clamping base 16 which is positioned between two rotary shafts 12, 20, a magnet plate 23*c* is disposed. When the first clamp plate 13 and the second clamp plate 21 are in the released state where they do not hold the stencil sheet M, they are overlapped in this region and are attracted to and fixedly secured to the magnetic plate 23*c*.

As shown in FIG. 2, at a given position in the vicinity of the printing drum 1, clamp drive means 25 which drive the first and second holding means 10, 18 are disposed. The clamp drive means 25 includes a base plate 26, a first clamp motor 27 and a second clamp motor 28 which are mounted on the base plate 26 and the first and second rotary shafts 29, 30 which are driven by respective motors. The clamp drive means 25 is also provided with moving means which moves the base plate 26 parallel to the central axis of the printing drum 1. When the printing drum 1 is set at a mounting start position or a mounting completion position of the stencil sheet M, the first and second rotary shafts 29, 30 are disposed at positions which respectively correspond to the first and second connecting plates 14, 22. With the printing drum 1 held at such a position, when the base plate 26 is moved in a moving direction indicated by an arrow in FIG. 2, the rotary shafts 29, 30 are respectively engaged with the connecting plates 14, 22. Here, when the clamp motors 27, 28 are driven, the clamp plates 13, 21 are rotated.

Figure 4:
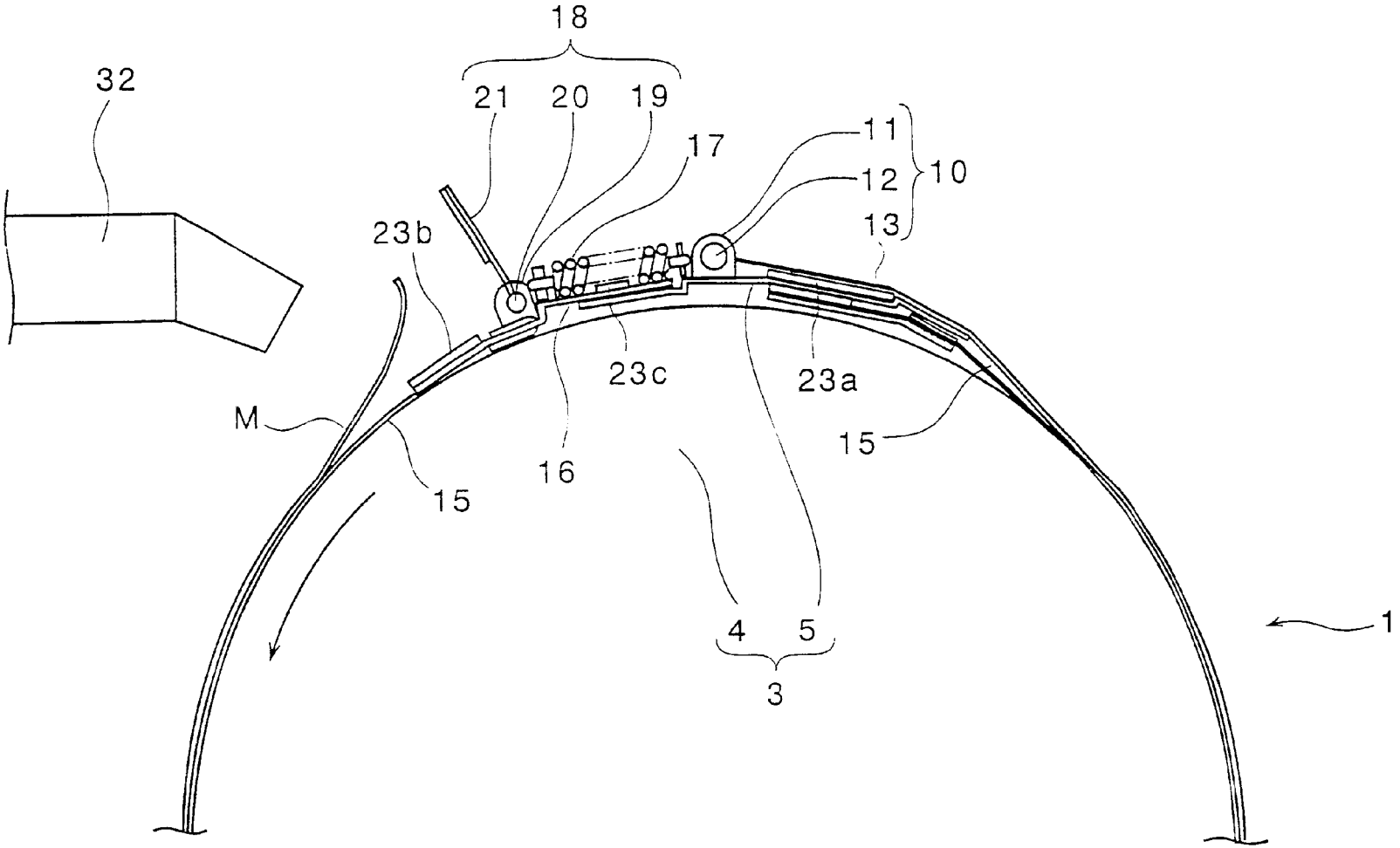
FIG. 4 is a cross-sectional view showing the operation of a fan in the first embodiment.

As shown in FIG. 4, a fan 32 which works as blower means is disposed in the vicinity of the printing drum 1. This fan 32 functions as means for moving the trailing end portion of the stencil sheet M which is lifted onto the second stencil clamping base 16. The position of the fan 32 is disposed slightly behind in the rotating direction of the second holding means 18 when the printing drum 1 is set at the mounting completion position of the stencil sheet M. That is, as shown in FIG. 4, when the winding of the stencil sheet M is completed along with the rotation of the printing drum 1, the trailing end portion of the stencil sheet M which is not held is clamped and the second clamp plate 21 and the fan 32 face each other in an opposed manner. Here, upon operation of the fan 32, the trailing end portion of the stencil sheet M can be moved by the wind and can be pushed onto the second stencil clamping base 16. Then, by operating the second clamp plate 21 in the closing direction, the trailing end portion of the stencil sheet M can be held between the second clamp plate 21 and the second stencil clamping base 16.

Figure 5:
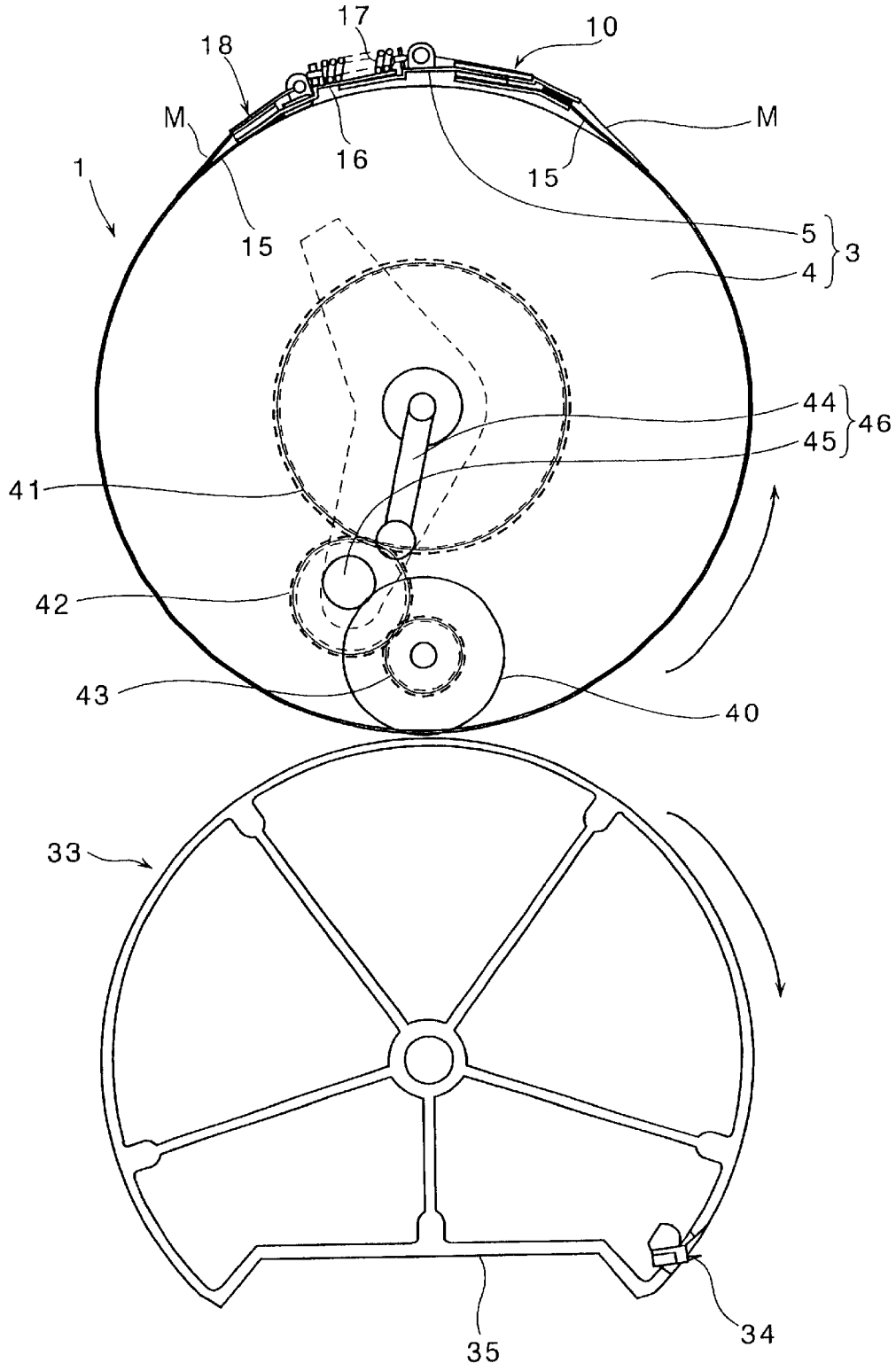
FIG. 5 is a cross-sectional view showing the whole of the first embodiment.

As shown in FIG. 5, in the inside of the printing drum 1, a squeezing roller 40 is disposed. The squeezing roller 40 is mounted on a tilting member not shown in the drawing and is elevatable in the inside of the printing drum 1. The squeezing roller 40 is rotatably driven in the same direction with the printing drum 1 in an interlocking manner by way of a drive gear 41 which is coaxially mounted with the printing drum 1, an intermediate gear 42 and a squeezing gear 43 of the squeezing roller 40. Further, in synchronous with the rotation of the printing drum 1, the squeezing roller 40 presses the ink passing member 15 outwardly at a given timing. Ink is supplied to the inside of the printing drum 1 by way of an ink supply pipe 44 and then a constant amount of ink is supplied to a peripheral surface of the squeezing roller 40 by means of a doctor roller 45 disposed against the squeezing roller 40 with a given distance therebetween.

As shown in FIG. 5, a pressure drum 33 is disposed below the printing drum 1. The diameter of the pressure drum 33 is approximately equal to the diameter of the printing drum 1. In the non-printing state, a minute clearance is defined between the printing drum 1 and the pressure drum 33. In synchronous with the rotation of the printing drum 1, the pressure drum 33 is rotatably driven in the direction opposite to the rotating direction of the printing drum 1. A holding pawl 34 which holds a leading end of a printing paper is disposed on an outer peripheral surface of the pressure drum 33 such that the holding pawl 34 can be opened and closed. On the outer peripheral surface of the pressure drum 33, a recessed portion 35 for preventing the interference with the first and second holding means 10, 18 is formed.

The manner of operation of the stencil printing machine of the present invention is hereinafter explained.

Upon completion of the printing, the clamp drive means 25 is connected to the first and second holding means 10, 18 and the first and second clamp plates 13, 21 are opened. First, the second clamp plate 21 is opened and is magnetically fixed at the open position and then the first clamp plate 13 is opened and is magnetically fixed onto the second clamp plate 21 disposed at the open position. Here, the clamp drive means 25 is retracted from the printing drum 1 and the printing drum 1 is rotated. The trailing end portion of the used stencil sheet M is taken into stencil discharge means. Along with the rotation of the printing drum 1, the stencil sheet M is peeled off from the printing drum 1 and is accommodated in the stencil discharge means.

The printing drum 1 is set at the mounting start position for a new stencil sheet M shown in FIG. 1. As shown in FIG. 2, the clamp drive means 25 is operated so as to make the first and second clamp motors 27, 28 approach the printing drum 1 and the first and second rotary shafts 29, 30 are respectively connected to the first and second connecting plates 14, 22. The stencil sheet M to which an image perforation is performed by stencil making means is fed toward the printing drum 1 by a given amount by way of feed rollers 303 as shown in FIG. 1. Subsequently, the first clamp motor 27 is rotated in the clockwise direction as shown in FIG. 1 and the first clamp plate 13 is closed. The leading end portion of the stencil sheet M is clamped and held between the first stencil clamping base 5 and the first clamp plate 13.

The clamp drive means 25 is retracted to the standby position. The printing drum 1 is rotated in the counterclockwise direction in FIG. 1 in the state that the leading end portion of the stencil sheet M is clamped by the first clamp plate 13. The stencil sheet M is wound around an outer peripheral surface of the ink passing member 15. The stencil sheet M is cut to a length of prescribed one sheet with a cutter.

The printing drum 1 is stopped in the state that the printing drum 1 is rotated one turn and is again set to the above-mentioned mounting start position. The clamp drive means 25 is again operated and the first and second rotary shafts 29, 30 are respectively connected to the first and second connecting plates 14, 22. As shown in FIG. 4, in this state, the fan 32 blows wind to the trailing end portion of the stencil sheet M. The trailing end portion of the stencil sheet M is pressed to the second stencil clamping base 16 by wind. In this state, the second rotary shaft 30 is rotated in the counterclockwise direction as shown in FIG. 4 by the second clamp motor 28 so as to close the second clamp plate 21. The trailing end portion of the stencil sheet M is clamped and held between the second stencil clamping base 16 and the second clamp plate 21. After the clamp drive means 25 is retracted to the standby position, the printing of the newly mounted stencil sheet is started. During printing, although the stencil sheet M is pulled along with the movement of the stencil sheet M and the ink passing member 15 toward the pressure drum 33, the spring 17 is elongated so that no unreasonable force is generated on the stencil sheet M.

According to this embodiment, the second holding means 18 holds the trailing end portion of the stencil sheet M so that the trailing end portion of the stencil sheet M is prevented from being stained by the ink adhered to the stencil discharge means.

In this embodiment, the stencil printing machine includes the printing drum 1 which winds the flexible ink passing member 15 around the base body 3 and fixedly secures the flexible ink passing member 15 by means of the spring 17 and the pressure drum 33 which has a contour substantially equal to that of the printing drum 1. Then, during printing, when the ink passing member 15 is pushed outwardly and is deformed by means of a squeezing roller 40, the stencil sheet M on the ink passing member 15 is pressed to the printing paper which the pressure drum 33 holds and conveys thus performing the printing. In the stencil printing machine having such a structure, when the surface speed X of the stencil sheet M on the printing drum 1 is greater than the surface speed Y of the pressure drum 33, it gives rise to an unfavorable effect that the stencil sheet M is elongated and the perforated image is deformed. On the other hand, when the surface speed Y of the pressure drum 33 becomes greater than the surface speed X of the stencil sheet M on the printing drum 1, the stencil sheet M is displaced toward the upstream.

According to this embodiment, the surface speed Y of the pressure drum 33 is set to a speed slightly faster than the surface speed X of the stencil sheet M on the printing drum 1 thus preventing the elongation of the stencil sheet M. With such a constitution, since the leading end portion and the trailing end portion of the stencil sheet M are respectively fixedly secured by the first holding means 10 and the second holding means 18, the elongation and the displacement of the stencil sheet M mounted on the printing drum 1 is small.

In the stencil printing machine of this embodiment, the printing is performed such that the flexible cylindrical ink passing member 15 is pushed and deformed outwardly and the printing sheet is sandwiched between the ink passing member 15 and the pressure drum 33. In the stencil printing machine having such a constitution, since the ink passing member 15 is flexibly wound around the circular plate members 4, the second holding means 18 is mounted on the second stencil clamping base 16 which is fixedly secured to the other end portion of the ink passing member 15. However, the present invention is also applicable to a stencil printing machine having the rigid cylindrical printing drum 1 which winds the stencil sheet thereon and a press roller which is elevatably disposed below the printing drum 1 and presses the printing paper to the stencil sheet. In this case, two holding means for holding the leading end portion and trailing end portion of stencil sheet are respectively provided at positions fixed on the outer peripheral portion of the printing drum.

Figure 6:
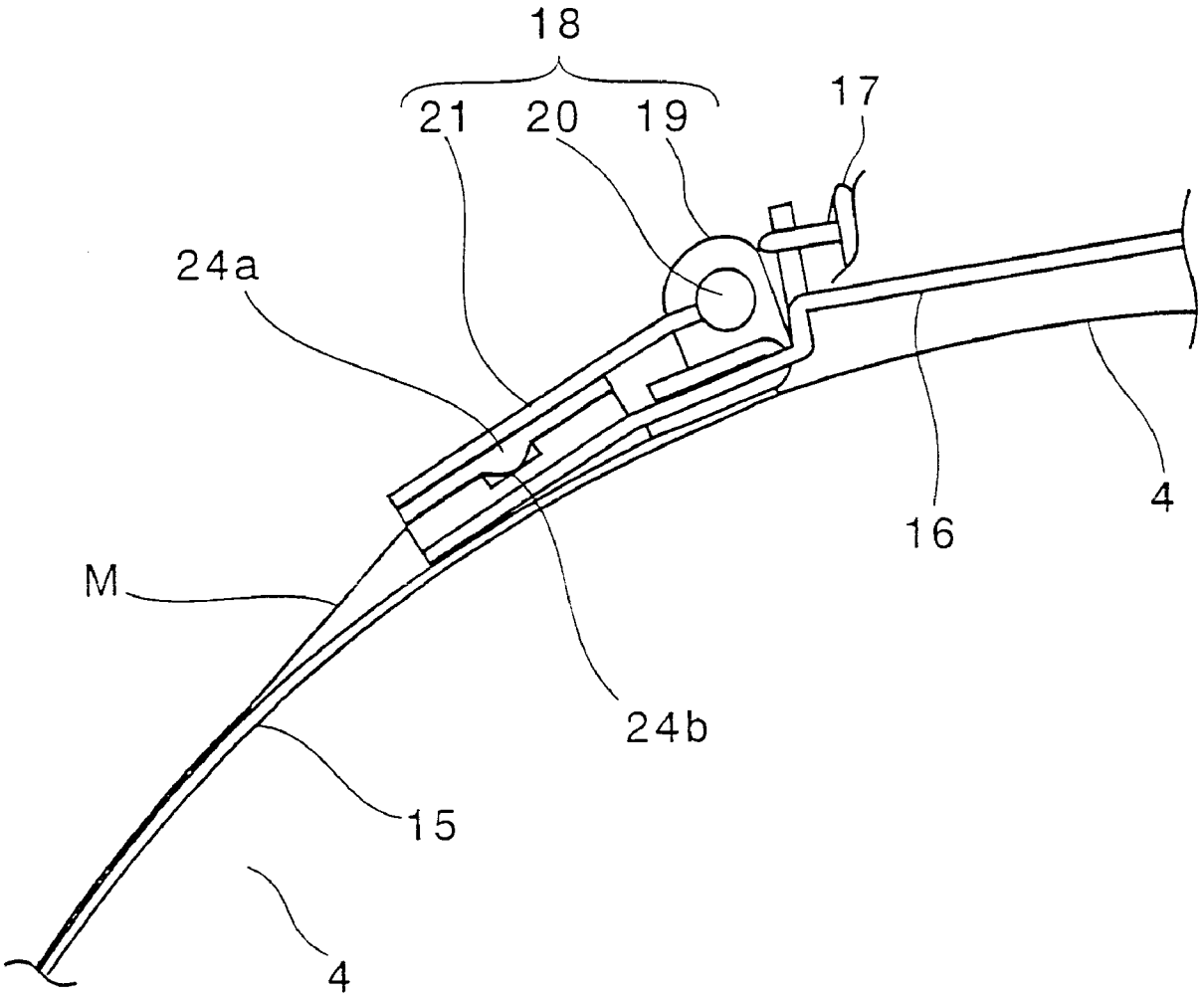
FIG. 6 is a cross-sectional view showing another structural example of a second clamp plate in the first embodiment.

FIG. 6 shows another constitutional example of the second clamp plate 21.

A protrusion 24*a* is formed on a lower surface of the second clamp plate 21. A recessed portion 24*b* with which the protrusion 24*a* of the second clamp plate 21 is engaged is formed on an upper surface of the second stencil clamping base 16. Accordingly, by sandwiching the stencil sheet M between the second clamp plate 21 and the second stencil clamping base 16, the stencil sheet M can be held between the protrusion 24*a* and the recessed portion 24*b* and is surely fixedly secured. Accordingly, it becomes possible to fixedly secure the stencil sheet M in the state that a constant tension is applied to the stencil sheet M. Further, in this example, since the protrusion 24*a* has a smooth spherical shape, the stencil sheet M is hardly broken.

Figure 7:
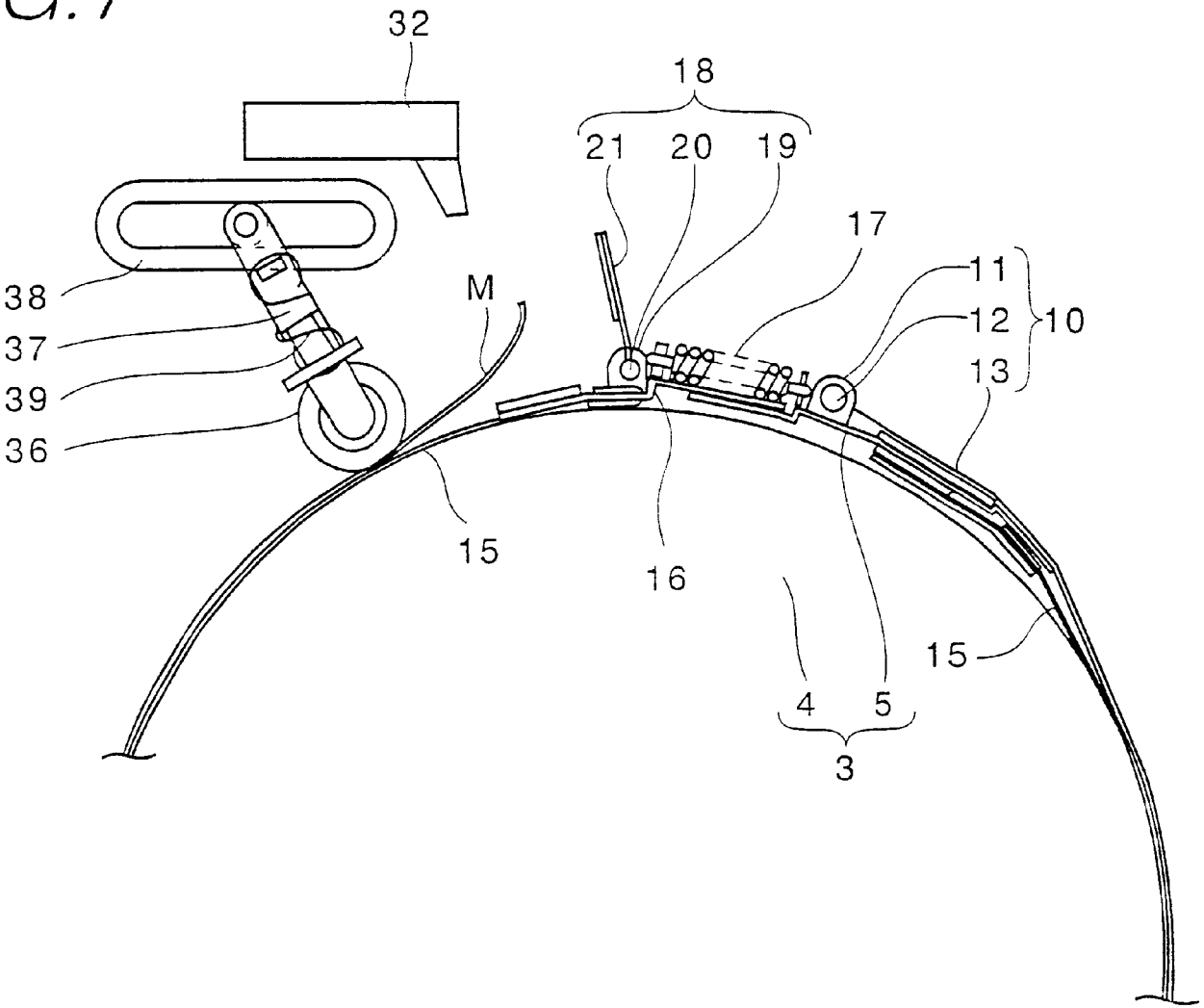
FIG. 7 is a cross-sectional view of the first embodiment which is further provided with clamp drive means.

FIG. 7 shows a second example of the present invention. The clamp drive means 25 of the first example uses the first clamp motor 27 and the second clamp motor 28 for opening and closing the first and second clamp plates 13, 21. Although the detail is not illustrated, the clamp drive means of this second example includes one clamp motor and one rotary shaft.

Further, in this second example, in addition to the fan 32, the stencil printing machine is provided with a press roller 36 as a press member which presses the trailing end portion of the stencil sheet M to the surface of the second stencil clamping base 16. The press roller 36 is rotatably mounted on one end of a telescopically extendible arm 37. The other end of the arm 37 is constituted such that it is movable along a guide 38. The arm 37 is movable along the guide 38 by means of a drive device not shown in the drawing. An arm spring 39 is mounted on the arm 37 so as to push the press roller 36 to the printing drum 1 with a uniform pressure. The other structure of the stencil printing machine of this embodiment is equal to the corresponding structure of the first embodiment.

The printing drum 1 is set at the mounting position of the stencil sheet M. The clamp drive means moves the clamp motors toward the printing drum 1. The rotary shaft is connected to the first connecting plate 14 of the first clamp plate 13. Upon operation of the clamp motor, the first clamp plate 13 is released. Also in this example, as in the case of the example shown in FIG. 1, the stencil sheet M which is subjected to the image perforation in the stencil making section is fed to the printing drum 1 by a given amount by way of the feed rollers 303. When the leading end portion of the stencil sheet M arrives at a position above the first stencil clamping base 5 of the printing drum 1, the conveyance of the stencil sheet M is stopped and the first clamp plate 13 is closed. Thereafter, the clamp drive means is retracted to the standby position. The printing drum 1 is rotated in the counterclockwise direction in the state that the leading end portion of the stencil sheet M is sandwiched by the first clamp plate 13. The stencil sheet M is wound around the printing drum 1 and is cut by the cutter. The printing drum 1 is stopped at the position where the second connecting plate 22 of the second clamp plate 21 is aligned with the rotary shaft.

Here, the clamp drive means is moved toward the printing drum 1 so as to make the rotary shaft and the second connecting plate 22 engage with each other. Upon driving of the clamp motor, the second clamp plate 21 is rotated in the counterclockwise direction shown in FIG. 7. At a point of time that the second clamp plate 21 is rotated to the state shown in FIG. 7, the press roller 36 is moved toward the printing drum 1 so as to press the stencil sheet M to the printing drum 1. The trailing end portion of the stencil sheet M is moved to a position above the second stencil clamping base 16. Along with such operation, the fan 32 is operated so as to facilitate the moving of the trailing end portion of the stencil sheet M to the position above the second stencil clamping base 16. Then, the clamp motor is driven. The second clamp plate 21 clamps and fixes the trailing end portion of the stencil sheet M between the second clamp plate 21 and the second stencil clamping base 16.

Although, in the above embodiment, as a member for pressing the stencil sheet M onto the surface of the printing drum 1 with a constant force, the press roller 36 is used, so long as the member has a shape which does not injure the stencil sheet M, the member is not limited to the roller. For example, a press member having a non-roller shape which is made of metal, resin or the like may be used.

Further, in this example, in place of the second clamp plate 21, an adhesive region which has a given stickiness may be formed on the surface of the second stencil clamping base 16 as second holding means. In this manner, by moving the press roller 36 to the position above the second stencil clamping base 16 while pressing the stencil sheet M, the trailing end portion of the stencil sheet M is brought into close contact with the second stencil clamping base 16 and is fixedly secured to the second stencil clamping base 16. The stickiness of the adhesive region of the second stencil clamping base 16 is preferably of a strength which allows the rapid peeling off at the time of discharging the stencil sheet M.

Figure 8:
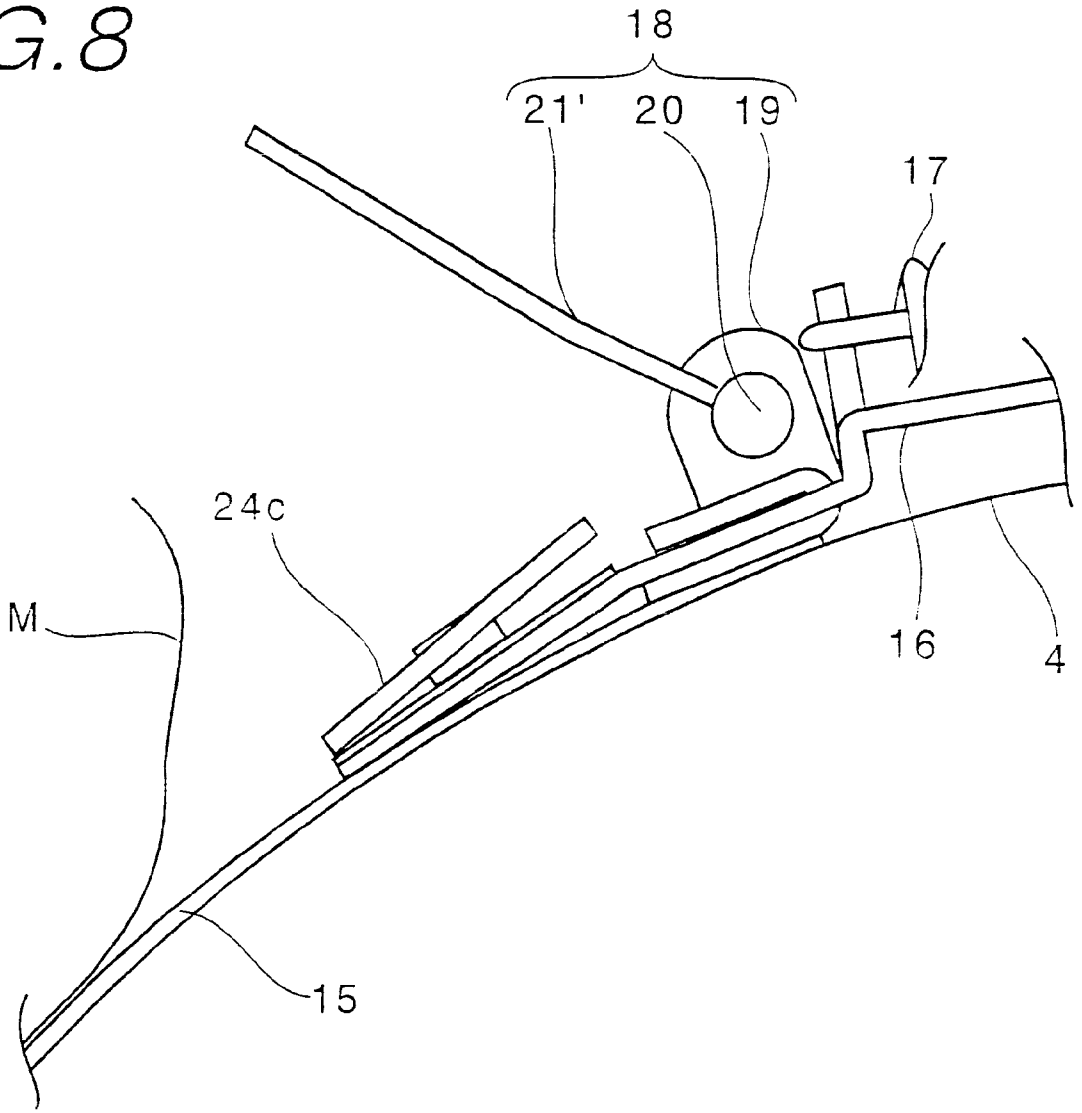
FIG. 8 is a cross-sectional view showing a modification of the second stencil clamping base in the first embodiment.
Figure 9:
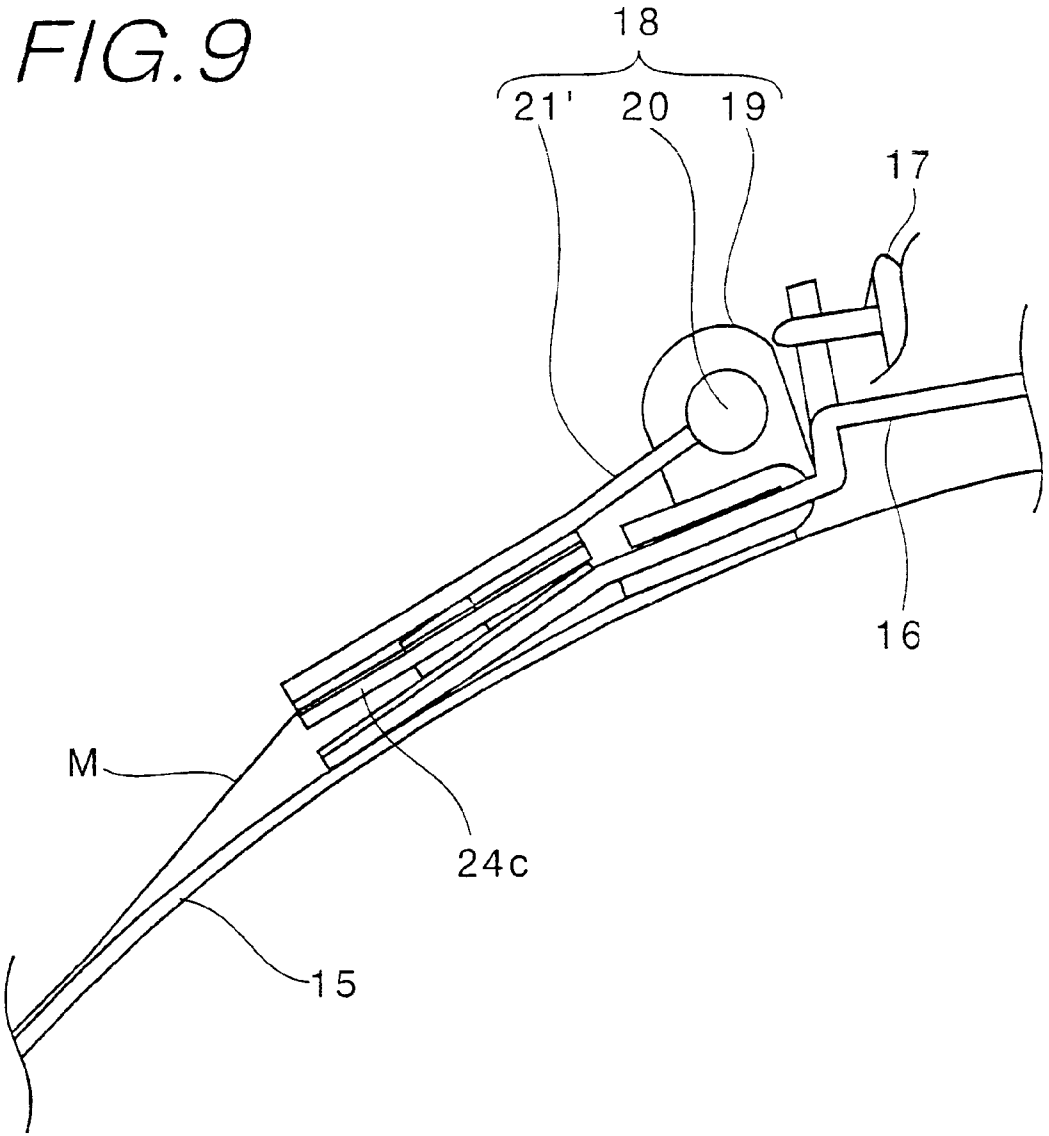
FIG. 9 is a cross-sectional view showing a modification of the second stencil clamping base in the first embodiment.

FIG. 8 and FIG. 9 show a modification of the second holding means 18 and the second stencil clamping base 16.

The second stencil clamping base 16 is provided with a tilting plate 24*c*. The tilting plate 24*c* performs a movement similar to that of a seesaw using one point thereof as a fulcrum in the circumferential direction of the printing drum 1. When a second clamp plate 21' is opened as shown in FIG. 8, the tilting plate 24*c* has a side thereof which is disposed close to a second rotary shaft 20 elevated high, while when the second clamp plate 21' is closed as shown in FIG. 9, the tilting plate 24*c* has the side thereof which is disposed close to the second rotary shaft 20 pressed downwardly and a side thereof which is remote from the second rotary shaft 20 is lifted.

Accordingly, when the trailing end portion of the stencil sheet M is held between the second clamp plate 21' and the tilting plate 24*c*, the trailing end portion of the stencil sheet M is lifted by an end portion of the tilting plate 24*c* and takes the state that a given tension is applied to the stencil sheet M. The shape of the second clamp plate 21' is constituted such that the second clamp plate 21' is inclined with an inclination equal to that of the tilted tilting plate 24*c*.

[Embodiment B]

The second embodiment of the present invention is explained specifically in conjunction with drawings.

Figure 10:
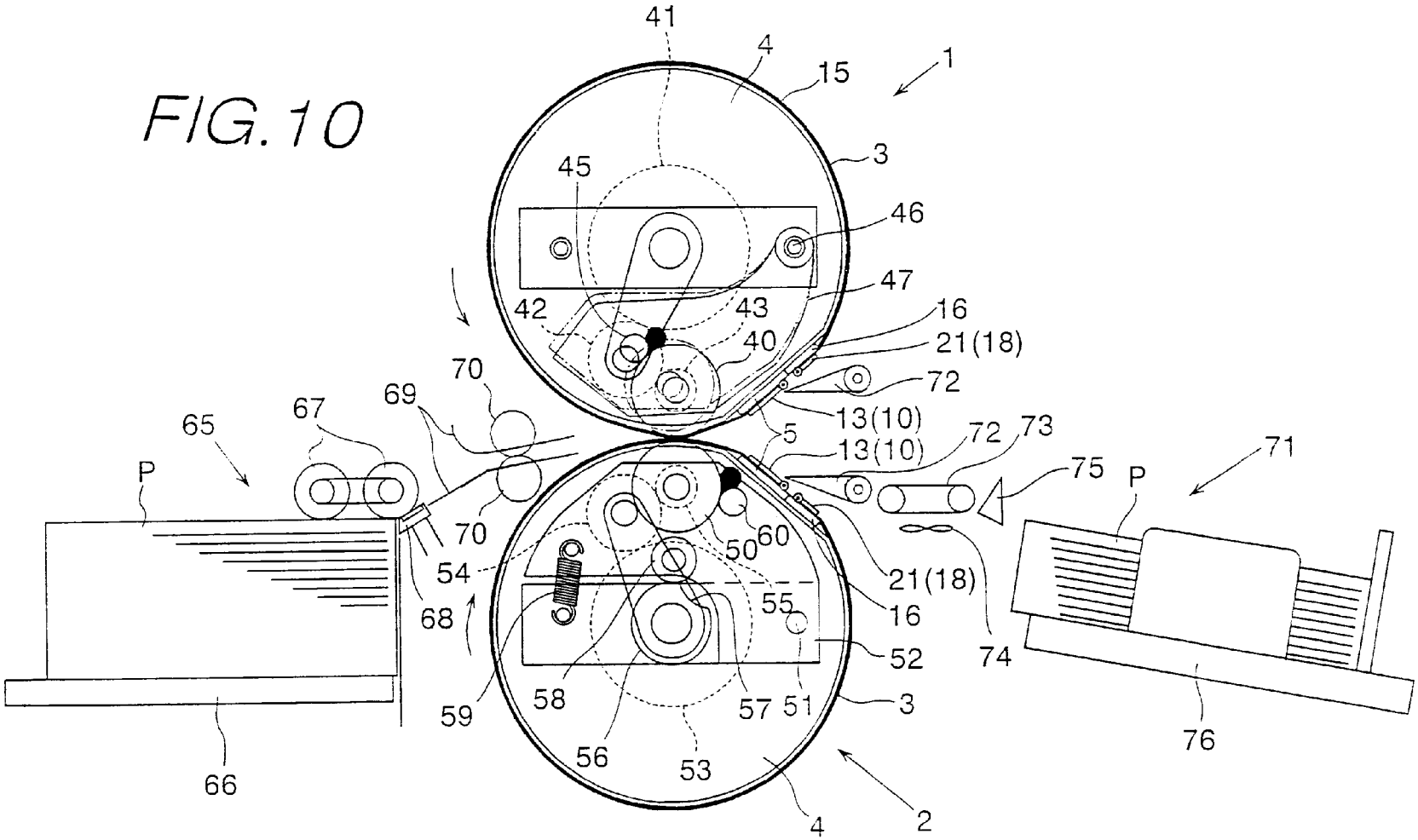
FIG. 10 is a side view showing the constitution of a printing section of a stencil printing machine of the second embodiment of the present invention.

As shown in FIG. 10, the stencil printing machine of the present embodiment has a first printing drum 1 (upper side) and a second printing drum 2 (lower side). As shown in FIG. 1, the constitutional parts of the first printing drum 1 (upper side) of this embodiment are equal to those of the stencil printing machine of the first embodiment. That is, the stencil printing machine of the present embodiment has the same constitution as that of the first embodiment with respect to the clamp drive means 25 shown in FIG. 2 and FIG. 3, the fan 32 shown in FIG. 4, the press member shown in FIG. 7, another structural example of the second clamp plate 21 shown in FIG. 6, the constitution which forms the adhesive region having a given stickiness on the surface of the second stencil clamping base 16 as the second holding means in place of the second clamp plate 21 not shown the drawing, and the modifications of the second holding means 18 and second stencil clamping base 16 shown in FIG. 8 and FIG. 9, in addition to the printing drum 1, the first holding means 10 and the second holding means 18. Accordingly, the same numerals are given to the corresponding constitutional parts and their explanation is omitted.

Figure 11:
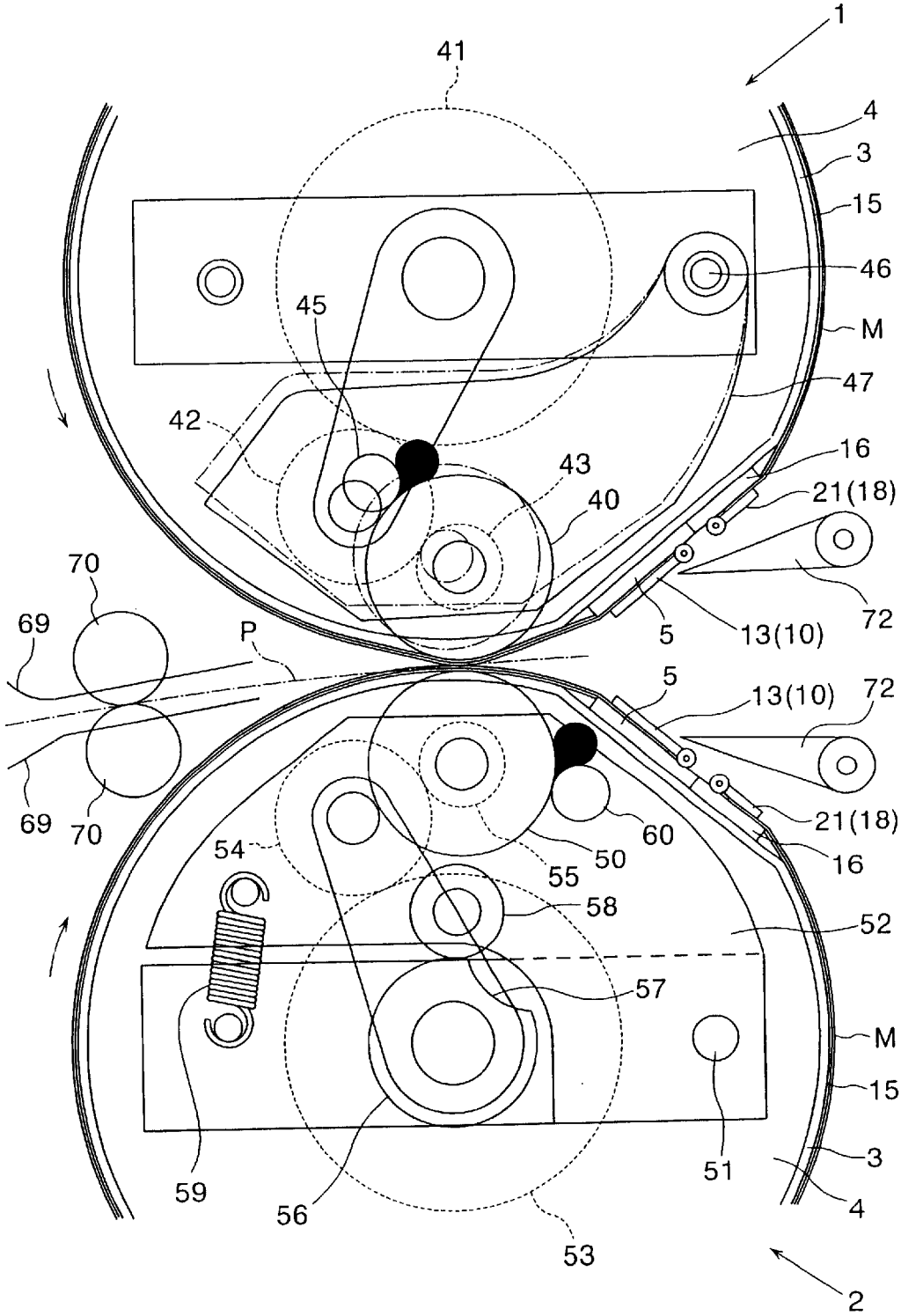
FIG. 11 is a partially enlarged view of the printing section.

As shown in FIG. 10 and FIG. 11, a squeezing roller 40 is disposed in the inside of the first printing drum 1. The squeezing roller 40 is rotatably supported on a roller support arm 47 which is pivotally supported in the approximately upward and downward directions by way of a pivot shaft 46 fixedly mounted in the inside of the first printing drum 1. Due to such a constitution, the squeezing roller 40 is elevatable in the inside of the first printing drum 1. The squeezing roller 40 is rotatably driven in the same direction as that of the first printing drum 1 in an interlocking manner with the rotation of the first printing drum 1 by way of a drive gear 41 coaxially mounted on the first printing drum 1, an intermediate gear 42 and a gear 43 of the squeezing roller 40.

The squeezing roller 40 comes into contact with the inner peripheral surface of the ink passing member 15 so as to press the ink passing member 15 outwardly (lower side). Further, the squeezing roller 40 is moved away from the inner peripheral surface of the ink passing member 15 at a given timing in synchronous with the rotation of the first printing drum 1. The timing that the squeezing roller 40 is moved away from the inner peripheral surface of the ink passing member 15 matches the timing that the stopper mechanism made of the first holding means 10 and the second holding means 18 pass the squeezing roller 40 and hence, the collision between the squeezing roller 40 and the inside of the stopper mechanism can be prevented.

The ink is supplied to the inside of the first printing drum 1 by way of an ink supply section not shown in the drawing and a given amount of ink is supplied to the peripheral surface of the squeezing roller 40 by means of a doctor roller 45 disposed against the squeezing roller 40 with a given distance between them.

Subsequently, the second printing drum 2 is explained hereinafter.

The second printing drum 2 is constituted in the same manner as that of the above-mentioned first printing drum 1 except for the constitution of the inside thereof. Accordingly, with respect to the second printing drum 2 which is explained hereinafter, parts which are identical with or equivalent to parts of the first printing drum 1 are given same numerals and their explanation is omitted.

In synchronous with the counterclockwise rotation of the above-mentioned first printing drum 1, the second printing drum 2 is rotatably driven in the clockwise direction (the direction opposite to the rotating direction of the first printing drum 1) shown by an arrow in FIG. 1 and FIG. 6 about a central axis thereof. In rotatably driving this second printing drum 2, the rotation may be interlocked with the rotation of the drive gear 8 provided for rotatably driving the first printing drum 1, for example.

Figure 12:
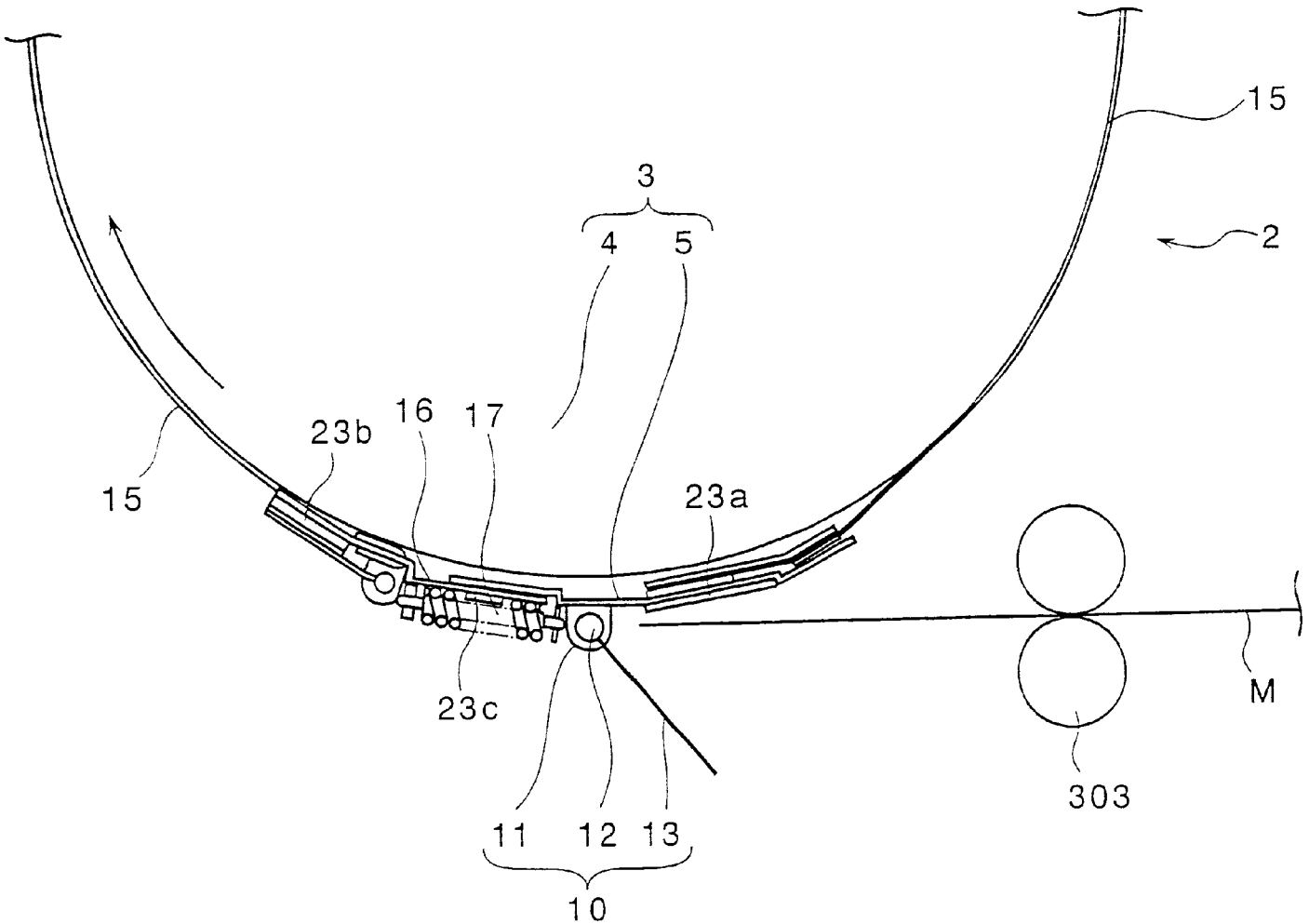
FIG. 12 is a side view showing a stopper mechanism in the printing section.
Figure 13:
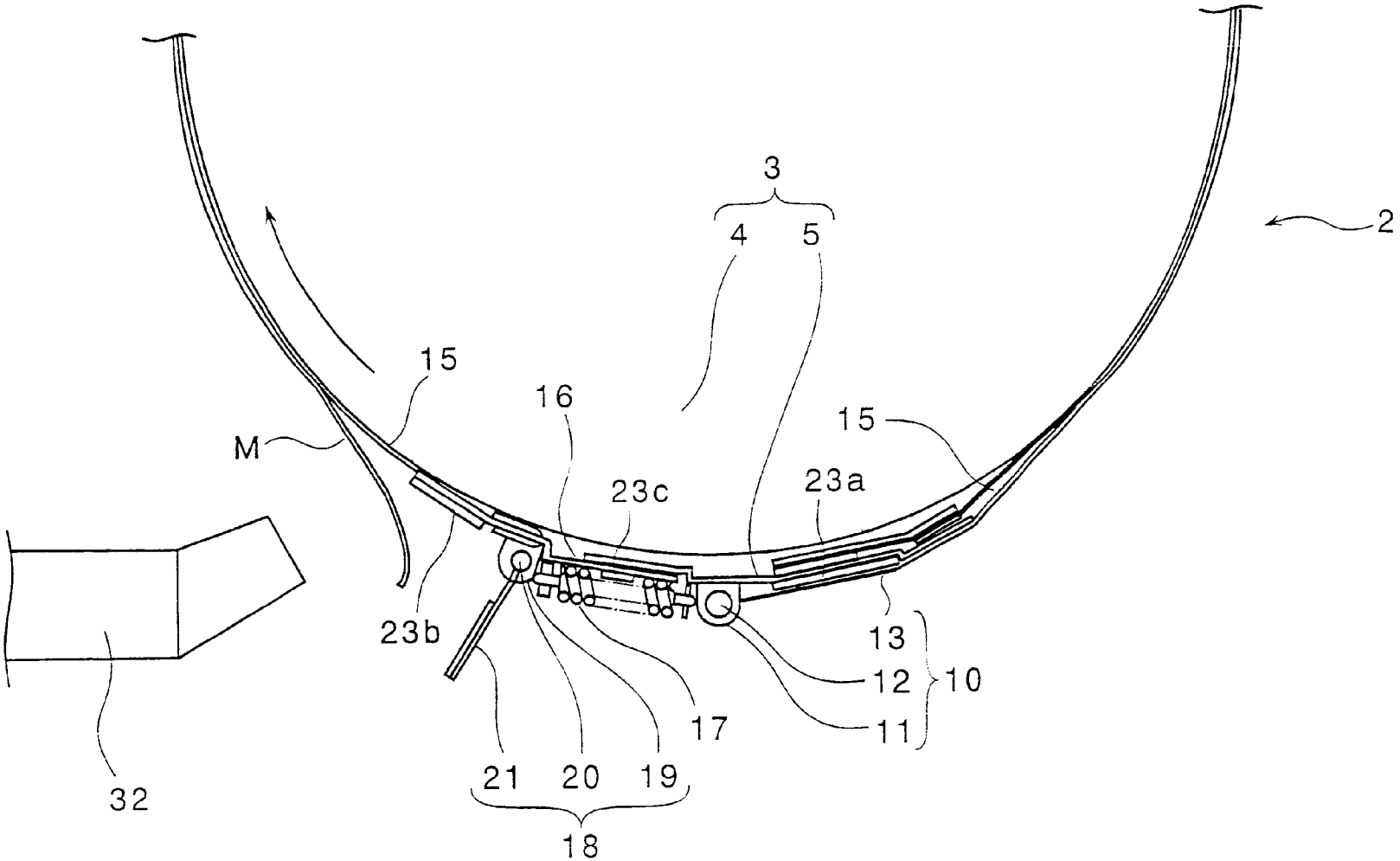
FIG. 13 is an operation explanatory view of the stopper mechanism.

In the same manner as the first printing drum 1, in the second printing drum 2, one end portion of the ink passing member 15 which is mounted on one end side of the first stencil clamping base 5 constitutes the upstream side with respect to the rotating direction of the second printing drum 2. Further, the other end portion of the ink passing member 15 fixedly secured to the second stencil clamping base 16 constitutes the downstream side with respect to the rotating direction of the second printing drum 2. That is, in the second printing drum 2, the ink passing member 15 mounted on the base body 3, the stopper mechanism which is constituted by the first holding means 10 and the second holding means 18 (see FIG. 12), the clamp drive means 25 (see FIG. 2 and FIG. 3) and the fan 32 (see FIG. 13) are constituted symmetrically with those of the first printing drum 1. Further, the second printing drum 2 is constituted such that the shapes of the circular plate members 4 and the diameter of a cylinder formed by the ink passing member 15 wound around the peripheral surface of the circular plate members 4 become approximately equal to those of the first printing drum 1.

As shown in FIG. 10 and FIG. 11, in the inside of the second printing drum 2, a squeezing roller 50 is disposed. The squeezing roller 50 is rotatably supported on a roller support arm 52 which is pivotally supported in the approximately upward and downward directions by way of a pivot shaft 51 fixedly mounted in the inside of the second printing drum 2. Due to such a constitution, the squeezing roller 50 is elevatable in the inside of the second printing drum 2. The squeezing roller 50 is rotatably driven in the same direction as that of the second printing drum 2 in an interlocking manner with the rotation of the second printing drum 2 by way of a drive gear 53 coaxially mounted on the second printing drum 2, an intermediate gear 54 and a gear 55 of the squeezing roller 50.

In the inside of the second printing drum 2, the cam 56 is disposed coaxially with the second printing drum 2. This cam 56 is rotated together with the second printing drum 2. On a peripheral surface of the cam 56, a recessed portion 57 which is directed to a stopper mechanism side mounted in the second printing drum 2 is formed. Further, the roller support arm 52 is provided with a cam follower 58. The cam follower 58 is positioned right above the cam 56. The roller support arm 52 has a tilting end portion side thereof always pulled downwardly by means of a spring 59. Due to such a constitution, the cam follower 58 is always brought into slide contact with the peripheral surface of the cam 56 including the recessed portion 57.

That is, the cam 56 which is rotated together with the second printing drum 2 upon rotation of the second printing drum 2 determines the elevating position of the squeezing roller 50 by the peripheral surface and the recessed portion 57 with which the cam follower 58 is brought into slide contact. When the cam follower 58 is brought into contact with the peripheral surface of the cam 56, the squeezing roller 50 is brought into contact with the inner surface of the ink passing member 15. Further, when the cam follower 58 is brought into contact with the recessed portion 57 of the cam 56, the squeezing roller 50 is moved downwardly away from the inner peripheral surface of the ink passing member 15. Accordingly, the collision between the squeezing roller 50 and the inside of the stopper mechanism can be avoided.

Ink is supplied to the inside of the second printing drum 2 by way of an ink supply section not shown in the drawing. A constant amount of ink is supplied to the peripheral surface of the squeezing roller 50 by means of a doctor roller 60 disposed against the squeezing roller 50 with a given distance between them.

In the printing section having such a constitution, the squeezing roller 40 of the first printing drum 1 presses the ink passing member 15 outwardly so as to bring the outer peripheral surface of the ink passing member 15 which is bulged outwardly toward the lower side and the outer peripheral surface of the ink passing member 15 of the second printing drum 2 disposed below the ink passing member 15 of the first printing drum 1 into contact with each other. Then, when the first printing drum 1 and the second printing drum 2 are brought into contact with each other, by feeding a printing paper P between the first and second printing drums 1, 2 which are respectively synchronously rotated, a duplex printing is performed on both surfaces of the printing paper P.

The printing paper P is fed to the printing section by means of a paper feed section 65. As shown in FIG. 10, the paper feed section 65 includes a paper feed table 66 on which printing papers P are stacked. By means of respective feed rollers 67 and a paper stripper member 68, the printing papers P stacked on a paper feed table 66 are taken out one by one. The taken-out printing paper P is conveyed to a nip portion formed between a pair of timing rollers 70 by way of upper and lower paper guide members 69. A pair of timing rollers 70 feed the printing paper P between the first and second printing drums 1, 2 at a given timing.

Further, the printing paper P to which a printing is applied is taken out from the printing section by means of a paper discharge section 71. As shown in FIG. 10, the paper discharge section 71 includes respective paper peeling-off pawls 72 which peel off the printing paper P upon rotation of the first and second printing drums 1, 2. The printing paper P which is peeled off from the first or second printing drum 1, 2 by means of a paper peel-off pawl 72 is fed to a paper discharge belt 73. Below the paper discharge belt 73, a paper discharge fan 74 is provided so as to suck the printing paper P to the paper discharge belt 73 side. The printing paper P fed to the paper discharge belt 73 is formed in a U-shape as seen from the paper discharge direction by means of a paper discharge guide 75 so that some rigidity is given to the printing paper P. Then, the printing paper P is flown to a discharge paper table 76.

Hereinafter, the manner of operation of the stopper mechanism in the printing by the stencil printing machine of the second embodiment is explained.

At the time of printing, the printing paper P which is fed between the first and second printing drums 1, 2 rotated synchronously is nipped or sandwiched between the stencil sheet M wound around the bulged ink passing member 15 of the first printing drum 1 and the stencil sheet M wound around the ink passing member 15 of the second printing drum 2. On both surfaces of the printing paper P which is nipped by respective stencil sheets M, ink which passes through perforated portions of respective stencil sheets M is transferred so that given images are respectively formed thus performing the printing.

In performing the printing in this manner, the stencil sheet M receives a stress in the following manner. First of all, the first printing drum 1 and the second printing drum 2 are formed such that the diameters of cylinders made by respective ink passing members 15, 15 are set approximately equal. However, when the diameter of the first printing drum 1 is locally enlarged, for example, the peripheral speed of the first printing drum 1 is increased so that the surface speed X of the stencil sheet M wound around the ink passing member 15 of the first printing drum 1 becomes faster than the surface speed Y of the stencil sheet M wound around the ink passing member 15 of the second printing drum 2. Accordingly, the stencil sheet M of the second printing drum 2 side having the slow surface speed receives a stress directed to the leading end portion side with respect to the rotating direction of the second printing drum 2.

Upon receiving the stress directed toward the leading end portion side, the stencil sheet M of the second printing drum 2 side is about to move toward the leading end portion side. However, since the above-mentioned stopper mechanism also clamps the trailing end portion side of the stencil sheet M, the movement of the stencil sheet M is prevented and the stencil sheet M can maintain its original wound position.

Accordingly, the problems such as the contraction or shrinkage of a printed image caused by the stencil sheet M of the second printing drum 2 side, the wrinkles formed on the stencil sheet M or the staining of the printing paper P caused by the movement of the stencil sheet M to a position where the stencil sheet M cannot cover the ink passing portion of the second printing drum 2 can be avoided.

On the other hand, when the diameter of the second printing drum 2 is locally enlarged, the surface speed of the stencil sheet M wound around the ink passing member 15 of the second printing drum 2 becomes faster than the surface speed of the stencil sheet M wound around the ink passing member 15 of the first printing drum 1. Accordingly, the stencil sheet M of the first printing drum 1 side having the slow surface speed receives a stress directed to the leading end portion side with respect to the rotating direction of the first printing drum 1. However, since the stopper mechanism mounted on the first printing drum 1 also clamps the leading end portion and the trailing end portion of the stencil sheet M, the above-mentioned movement of the stencil sheet M does not take place.

Accordingly, in the stencil printing machine having the above-mentioned constitution, when printing is applied to both surfaces of the printing paper by means of the first printing drum 1 and the second printing drum 2, since they are provided with stopper mechanisms which clamp the leading end portions and the trailing end portions of respective stencil sheets M wound around the first and second printing drums 1, 2, even if the surface speed of the stencil sheet M wound around either one of the printing drums 1 (2) becomes slow, it does not give rise to the movement of the stencil sheets M so that a given printing can be performed on both surfaces of the printing paper.

Figure 14:
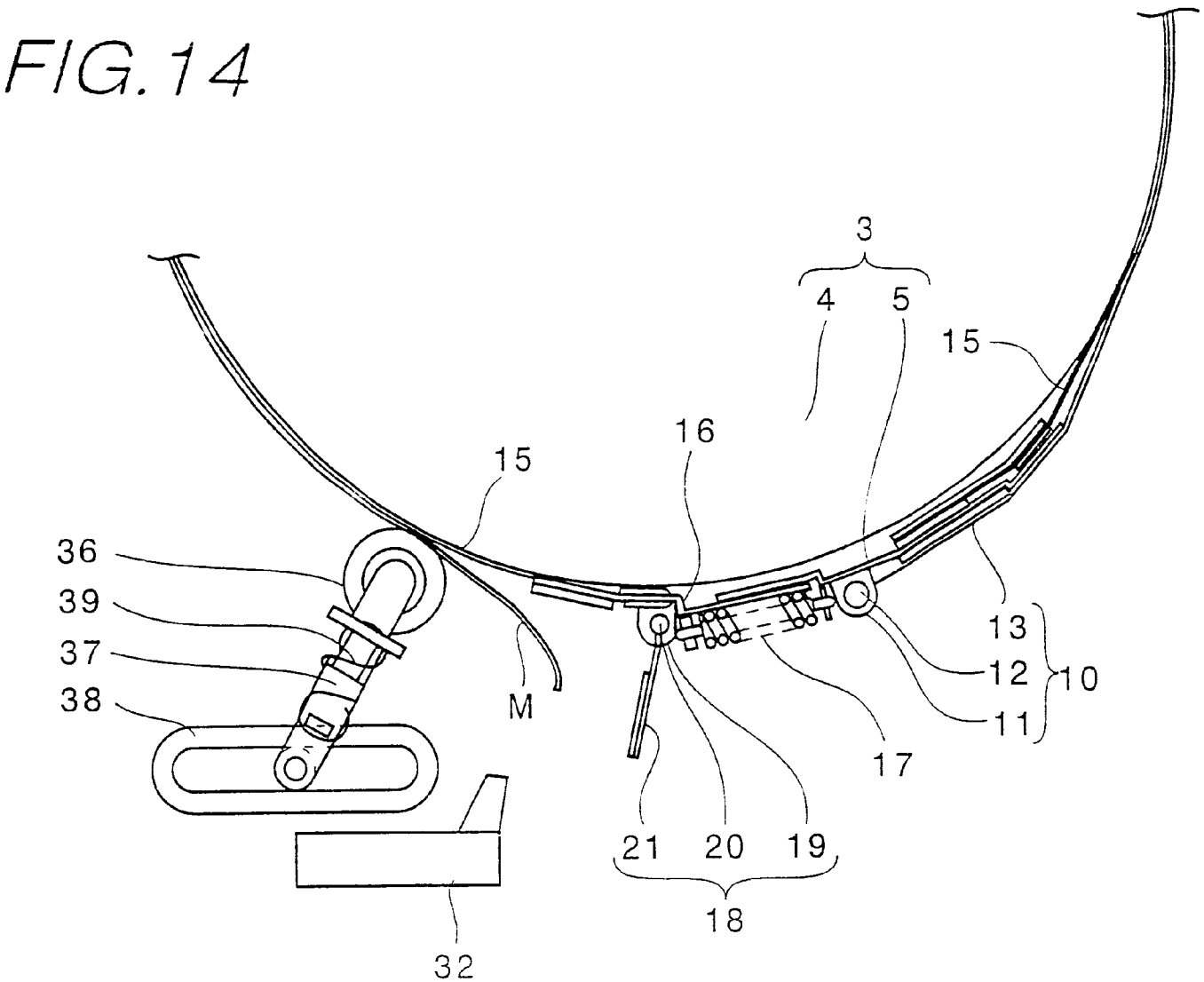
FIG. 14 is a cross-sectional view of the second embodiment which is further provided with clamp drive means.

Further, as shown in FIG. 14, as in the case of the first printing drum 1, the second printing drum 2 may be further provided with a press roller 36 which works as pressing member to press the trailing end portion of the stencil sheet M to the surface of the second stencil clamping base 16 in addition to the fan 32.

Further, as in the case of the first printing drum 1, the second printing drum 2 may be provided with another structural example of the second clamp plate 21 shown in FIG. 6, the constitution which forms the adhesive region having a constant stickiness on the surface of the second stencil clamping base 16 as the second holding means in place of the second clamp plate 21 not shown in the drawing, and the modification of the second holding means 18 and the second stencil clamping base 16 shown in FIG. 8 and FIG. 9.

Figure 15:
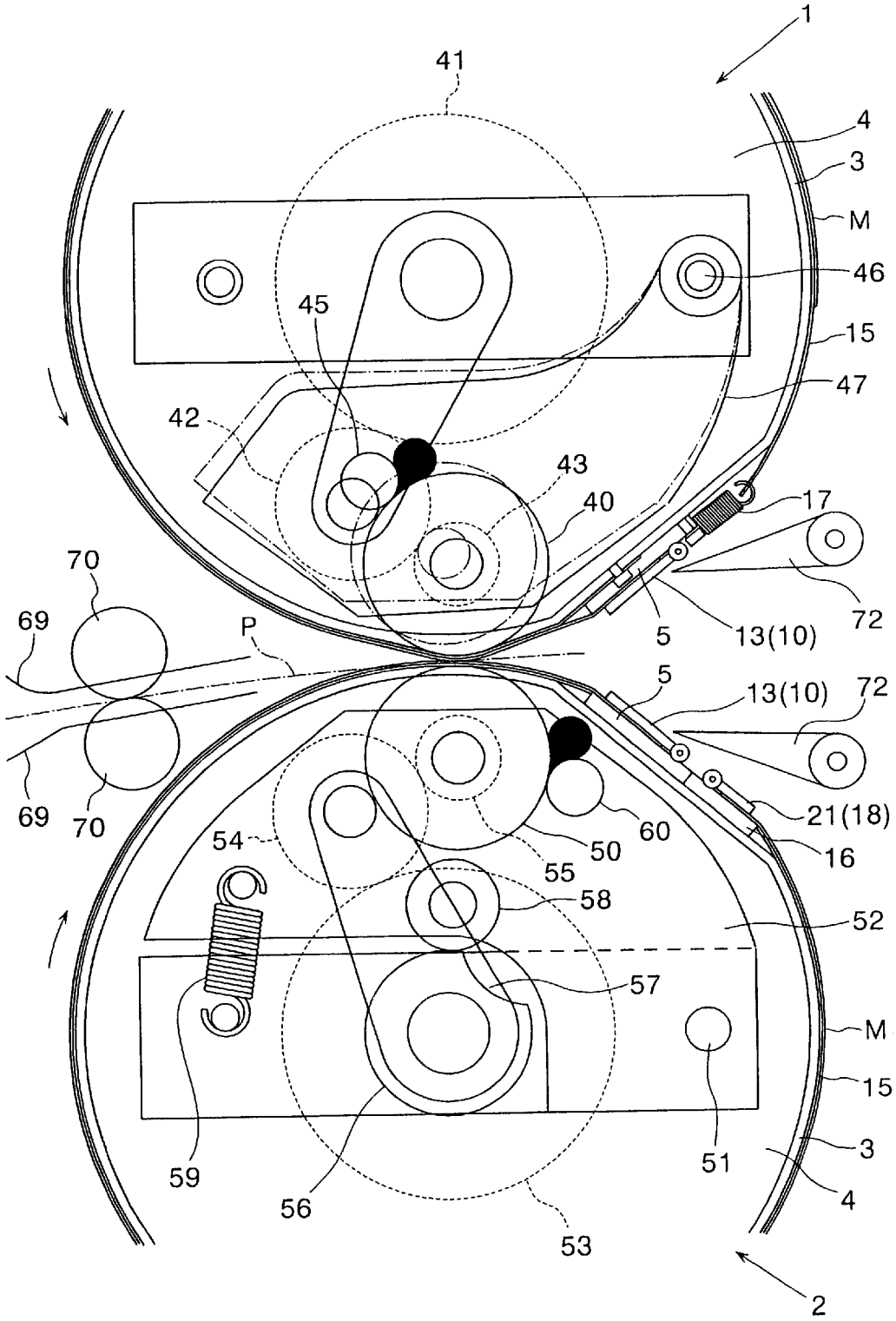
FIG. 15 is an enlarged side view showing the third embodiment directed to the constitution of the printing section of the stencil printing machine of the present invention.

Subsequently, the third embodiment of the present invention is explained specifically in view of FIG. 15.

In this third embodiment, constitutions which are identical with or equivalent to those of the above-mentioned constitutions of the first embodiment are given same numerals and their explanation is omitted.

In this stencil printing machine, the second printing drum 2 has the similar constitution as that of the above-mentioned second embodiment and is provided with a stopper mechanism which clamps the leading end portion and the trailing end portion of the stencil sheet M to be wound around the ink passing member 15. Further, the first printing drum 1 is constituted such that a stopper mechanism thereof clamps only the leading end portion of the stencil sheet M which is wound around the ink passing member 15. The constitution which enables the clamping of only the leading end portion of the stencil sheet M is the constitution which is provided with the first clamp plate 13 on the first stencil clamping base 15 as shown in FIG. 7. Further, the ink passing member 15 has an upstream-side end portion thereof fixedly secured to the first stencil clamping base 5 and a downstream-side end portion thereof supported on the first stencil clamping base 5 by way of the spring 17.

Due to such a constitution, it becomes possible to set the surface speed Y of the stencil sheet M of the second printing drum 2 side slower than the surface speed X of the stencil sheet M of the first printing drum 1 side by making the peripheral speed of the second printing drum 2 slower than the peripheral speed of the first printing drum 1. For example, the diameter of the second printing drum 2 is made smaller than the diameter of the first printing drum 1 (or alternatively, the diameter of the first printing drum 1 being made larger than the diameter of the second printing drum 2).

Hereinafter, the manner of operation of the stopper mechanism in the printing by the stencil printing machine of the third embodiment is explained. At the time of printing, the printing paper P which is fed between the first and second printing drums 1, 2 rotated synchronously is nipped or sandwiched between the stencil sheet M wound around the bulged ink passing member 15 of the first printing drum 1 and the stencil sheet M wound around the ink passing member 15 of the second printing drum 2. On both surfaces of the printing paper P which is nipped by respective stencil sheets M, ink which passes through perforated portions of respective stencil sheets M is transferred so that given images are respectively formed thus performing the printing.

In performing the printing in this manner, the stencil sheet M receives a stress in the following manner.

First of all, the peripheral speed of the second printing drum 2 is set slower than the peripheral speed of the first printing drum 1. Accordingly, the surface speed X of the stencil sheet M wound around the ink passing member 15 of the first printing drum 1 becomes faster than the surface speed Y of the stencil sheet M wound around the ink passing member 15 of the second printing drum 2. Therefore, the stencil sheet M of the second printing drum 2 side having the slow surface speed receives a stress directed to the leading end portion side with respect to the rotating direction of the second printing drum 2.

Upon receiving the stress directed toward the leading end portion side, the stencil sheet M of the second printing drum 2 side is about to move toward the leading end portion side. However, since the above-mentioned stopper mechanism also clamps the trailing end portion side of the stencil sheet M, the movement of the stencil sheet M is prevented and the stencil sheet M can maintain its original wound position.

Accordingly, the problems such as the contraction or shrinkage of printed image caused by the stencil sheet M of the second printing drum 2 side, the wrinkles formed on the stencil sheet M or the staining of the printing paper caused by the movement of the stencil sheet M to a position where the stencil sheet M cannot cover the ink passing portion of the second printing drum 2 can be avoided.

Accordingly, in the stencil printing machine of the third embodiment having the above-mentioned constitution, when printing is applied to both surfaces of the printing paper by means of the first printing drum 1 and the second printing drum 2, the second printing drum 2 is provided with the stopper mechanism which clamps the leading end portion and the trailing end portion of the stencil sheet M wound around the second printing drums 2, and the peripheral speed of the second printing drum 2 which clamps the leading end portion and the trailing end portion of the stencil sheet M is set slower than the peripheral speed of the first printing drum 1. Accordingly, the stencil sheet M wound around the first printing drum 1 is prevented from the movement thereof in the direction toward the leading end portion and the movement of the stencil sheet M of the second printing drum 2 is also prevented so that a given printing can be performed on both surfaces of the printing paper.

In the above-mentioned third embodiment, the stopper mechanism at the first printing drum 1 side may be constituted such that the mechanism clamps the leading end portion and the trailing end portion of the stencil sheet M and the surface speed X of the stencil sheet M wound around the first printing drum 1 is set slow. With such a constitution, the same advantageous effects can be also obtained.

Further, in the above-mentioned third embodiment, to increase the surface speed X (Y) of the stencil sheet M wound around the first printing drum 1 (or the second printing drum 2), for example, the gear ratio between the driven gear 6 and the drive gear 8 which are provided for driving the rotation of the printing drum 1 (2) may be changed besides increasing the diameter.

In the above-mentioned second and third embodiments, although they are constituted such that the ink passing member 15 of the first printing drum 1 is bulged, it may be possible to make the ink passing member 15 of the second printing drum 2 bulged. Further, the ink passing member 15 of the non-bulging side may be made of a rigid structure while excluding the flexible materials.

Further, in the second and third embodiments, first and second printing drums 1, 2 are constituted such that either one of the first printing drum 1 or the second printing drum 2 is bulged. However, the constitution is not limited to this. For example, either one of the first printing drum 1 or the second printing drum 2 may be capable of moving toward and away from the other printing drum and the printing paper may be fed when both of the first and the second printing drums 1, 2 are brought into contact with each other. In this case, the ink passing members 15 may be constituted such that the ink passing members 15 of both of the first and second printing drums 1, 2 are made of a flexible material, the ink passing members 15 of both of the first and second printing drums 1, 2 have a rigid structure, or the ink passing member 15 of either one of the first or second printing drum 1(2) is made of a flexible material and the ink passing member 15 of the other printing drum 2(1) has a rigid structure.

According to the present invention, two holding means which hold the leading end portion and the trailing end portion of the stencil sheet are provided to the printing drum around which the stencil sheet is wound. Due to such constitution, the trailing end portion of the stencil sheet wound around the printing drum is prevented from being lifted and hence, the trailing end portion of the stencil sheet wound around the printing drum is not brought into contact with other parts in the vicinity of the printing drum thereby it becomes possible to prevent the ink from staining these parts. Accordingly, the printing paper is not stained and the clear printed image can be obtained.

Further, by clamping both end portions of respective stencil sheets which are wound around along the rotational direction of respective printing drums, even when the peripheral speeds of respective drums are different, neither one of these stencil sheets is prevented from being moved. Due to such a constitution, troubles such as the shrinkage of the printed image formed by the stencil sheets, the wrinkle formed on the stencil sheets or the staining of printing paper due to the movement of the stencil sheet to a position where the stencil sheet cannot cover an ink non-passing portion can be avoided and hence, a given printing can be applied to both surfaces of the printing paper.

Further, by clamping both end portions of one stencil sheet which is wound around along the rotational direction of the outer peripheral surface of one printing drum and setting the peripheral speed of this printing drum lower than the peripheral speed of the other printing drum, while always applying a stress which moves toward the stencil sheet of one printing drum side, such movement can be prevented by the stopper mechanism. Due to such a constitution, troubles such as the shrinkage of the printed image formed by the stencil sheets, the wrinkle formed on the stencil sheets or the staining of printing paper due to the movement of the stencil sheet to a position where the stencil sheet cannot cover an ink non-passing portion can be avoided and hence, a given printing can be applied to both surfaces of the printing paper.

Particularly, the peripheral speeds of respective printing drums can be easily set by changing the diameters of the outer peripheral surfaces of respective printing drums.

Although the present invention has been described heretofore in conjunction with the preferred embodiments and modifications, the technical scope of the present invention is not limited to these embodiments and modifications and other embodiments and modifications are considered without departing from the spirit of the present invention.

What is claimed is:

1. A stencil printing machine comprising, a printing drum for receiving a perforated stencil sheet around an outer peripheral surface thereof, said printing drum being rotatable about a central axis thereof, first holding means provided to the outer peripheral surface of said printing drum for holding a leading end of said stencil sheet, second holding means provided to the outer peripheral surface of said printing drum for holding a trailing end of said stencil sheet, said second holding means including a second clamp plate having a first engaging device at a lower surface thereof, and a second clamp base having a second engaging device at an upper surface thereof to engage the first engaging device, said second holding means holding the trailing end of said stencil sheet by sandwiching the trailing end between the first and second engaging devices, and clamp driving means movably disposed with respect to the printing drum, said clamp driving means being connected to the first holding means and the second clamp plate only when the first holding means and the second clamp plate are rotated for holding or releasing the stencil sheet.

2. The stencil printing machine according to claim 1, further comprising a fan provided at a position in the vicinity of said printing drum, said fan blowing wind to the trailing end of the stencil sheet wound around the outer peripheral surface of said printing drum so as to move the trailing end toward the outer peripheral surface of said printing drum thereby enabling said second holding means to hold the trailing end between said second holding means and said printing drum.

3. The stencil printing machine according to claim 1, further comprising a press member movably provided at a position in the vicinity of said printing drum, said press member pressing the trailing end of the stencil sheet wound around the outer peripheral surface of said printing drum onto the outer peripheral surface of said printing drum thereby enabling said second holding means to hold the trailing end between said second holding means and said printing drum.

4. The stencil printing machine according to claim 1, wherein said clamp driving means includes a first clamp motor having a shaft for engaging the first holding means, and a second clamp motor having a shaft for engaging the second clamp plate.

5. The stencil printing machine according to claim 1, wherein said first engaging device is a protrusion, and said second engaging device is a recessed portion.

6. A stencil printing machine comprising, at least two printing drums for winding perforated stencil sheets on outer peripheral surfaces thereof, said two printing drums being rotatable about respective axes thereof, first holding means provided to the outer peripheral surfaces of said respective printing drums for holding leading end portions of said stencil sheets, and second holding means provided to the outer peripheral surfaces of said respective printing drums for holding trailing end portions of said stencil sheets, wherein the diameters of the outer peripheral surfaces of the at least two printing drums are different from each other, such that when the drums are rotated synchronously, the peripheral speed of one printing drum is slower than the peripheral speed of the other printing drum.

7. The stencil printing machine according to claim 6, further comprising fans provided at positions in the vicinity of said respective printing drums, said fans blowing wind to the trailing end portions of the stencil sheets wound around the outer peripheral surfaces of said printing drums so as to move the trailing end portions toward the outer peripheral surfaces of said printing drums thereby enabling said second holding means to hold the trailing end portions between said second holding means and said printing drums.

8. The stencil printing machine according to claim 6, further comprising press members movably provided at positions in the vicinity of said printing drums, said press members pressing the trailing end portions of the stencil sheets wound around the outer peripheral surfaces of said printing drums onto the outer peripheral surfaces of said printing drums thereby enabling said second holding means to hold the trailing end portions between said second holding means and said printing drums.

9. A stencil printing machine comprising, a printing drum for receiving a perforated stencil sheet around an outer peripheral surface thereof, said printing drum being rotatable about a central axis thereof, first holding means provided to the outer peripheral surface of said printing drum for holding a leading end of said stencil sheet, and second holding means provided to the outer peripheral surface of said printing drum for holding a trailing end of said stencil sheet, said second holding means including a second clamp plate having a first engaging device at a lower surface thereof, and a second clamp base having a second engaging device at an upper surface thereof to engage the first engaging device, said second clamp base having a magnet plate for attracting the second clamp plate so that the trailing end of the stencil sheet is held between the second clamp base and the second clamp plate by a magnetic force and is sandwiched between the first and second engaging devices.

* * * * *